US008517489B2

(12) United States Patent
Mano

(10) Patent No.: US 8,517,489 B2
(45) Date of Patent: Aug. 27, 2013

(54) PRINTING DEVICE AND PRINTING METHOD

(75) Inventor: Takahiro Mano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 13/178,095

(22) Filed: Jul. 7, 2011

(65) Prior Publication Data

US 2012/0013660 A1 Jan. 19, 2012

(30) Foreign Application Priority Data

Jul. 14, 2010 (JP) ..... 2010-159583

(51) Int. Cl.
*B41J 29/38* (2006.01)

(52) U.S. Cl.
USPC ..... 347/9; 347/5

(58) Field of Classification Search
USPC ..... 347/5, 9, 19, 16, 41
See application file for complete search history.

(56) References Cited

U.S. PATENT DOCUMENTS

2005/0093901 A1* 5/2005 Yraceburu et al. ..... 347/9
2009/0225122 A1* 9/2009 Tsuchiya ..... 347/15

FOREIGN PATENT DOCUMENTS

JP 2009-208380 A 9/2009

* cited by examiner

*Primary Examiner* — Stephen Meier
*Assistant Examiner* — Tracey McMillion
(74) *Attorney, Agent, or Firm* — Global IP Counselors, LLP

(57) ABSTRACT

The controller of the printing device sets the printing width in the secondary scanning direction of the region of the printing medium onto which ink is deposited by a single driving of the a printing unit, on the basis of the length in the secondary scanning direction of the printing region that is specified based on the printing data, and controls the printing unit on the basis of the set printing width.

8 Claims, 12 Drawing Sheets

PRINTING DEVICE AND PRINTING METHOD

CROSS-REFERENCE TO RELATED APPLICATIONS

This application claims priority to Japanese Patent Application No. 2010-159583 filed on Jul. 14, 2010. The entire disclosure of Japanese Patent Application No. 2010-159583 is hereby incorporated herein by reference.

BACKGROUND

1. Technological Field

The present invention relates to a printing device and printing method for printing on a printing medium by using ink or another printing material.

2. Background Technology

A serial-type inkjet printing device (hereinafter referred to simply as "printing device") is widely known as an example of a printing device for printing on a printing medium. This printing device is provided with a printing means (unit) which has a carriage (moving body) for moving in a primary scanning direction, and a print head for ejecting ink as a printing material, the print head being mounted on the carriage. The printing device is also provided with a conveyance device for conveying the printing medium in a secondary scanning direction which intersects the primary scanning direction. A control device of the printing device controls the printing means (unit) and the conveyance device so as to print an image which is in accordance with printing data on the printing medium in a case in which printing data transmitted from an external device, for example, are received (see Patent Citation 1).

Specifically, a printing medium which is fed to a position at which printing is possible is conveyed by the conveyance device a predetermined amount at a time. The carriage then begins to move in the primary scanning direction immediately after or immediately before conveyance of the printing medium by the conveyance device is temporarily stopped, and ink is appropriately ejected from nozzles of the print head mounted on the carriage. In other words, ejection of ink to the printing medium and conveyance (also referred to as "paper feeding") of the printing medium are performed in alternating fashion.

Japanese Patent Application Publication No. 2009-208380 (Patent Citation 1) is an example of the related art.

SUMMARY

Problems to Be Solved by the Invention

During printing, a data length (data amount) of printing data (divided printing data) corresponding to a single driving of the printing means is sent in sequence to the control device of the printing device. The data length of each unit of divided printing data is generally set according to the width (head length) of the print head in the secondary scanning direction. Therefore, the number of nozzles that can be used during printing, i.e., the number of candidate nozzles, is constant among the nozzles arranged in the conveyance direction.

However, the data length of the final divided printing data of the units of divided printing data is highly likely to be shorter than the data length of the other units of divided printing data. In this case, the number of candidate nozzles at the time of printing based on the final divided printing data is less than the number of candidate nozzles at the time of printing based on the other units of divided printing data. In a case in which the number of candidate nozzles fluctuates according to the data length of the divided printing data, in the control device, there can be an increase in processing related to driving of the printing means without an accompanying ink ejection to the printing medium from the print head during printing on the printing medium.

For example, in a case in which it is time for a flushing process to be performed during printing, ink is discharged into a cap or a flushing box from all of the nozzles that can be used during printing. To accomplish this flushing, before ink ejection based on the final divided printing data is performed, ink is ejected (discharged) also from nozzles (also referred to as "unused nozzles") not used in ink ejection based on the final divided printing data even in a case in which the flushing process is performed. Driving of the print head in this manner to cause ink to be discharged from the unused nozzles constitutes driving of the printing means without an accompanying ink ejection to the printing medium from the print head during printing on the printing medium.

The invention was developed in view of the foregoing problems, and one of advantages of the invention is to provide a printing device and printing method whereby printing on a printing medium can be performed more efficiently.

Means Used to Solve the Above-Mentioned Problems

In order to achieve the abovementioned objects, the printing device of the invention includes printing means (unit) having a print head for depositing a printing material on a printing medium; conveyance means (unit) for moving the printing medium in a predetermined conveyance direction in relation to the print head; and printing control means (unit) for controlling the printing means and the conveyance means on the basis of acquired printing data, and causing the depositing of the printing material on the printing medium and the relative movement of the printing medium to be performed; and the printing device further includes printing width setting means (unit) for setting a printing width in the conveyance direction of a region of the printing medium onto which the printing material is deposited by a single driving of the printing means, on the basis of the size in the conveyance direction of a printing region that is specified based on the printing data; wherein the printing control means controls the printing means and the conveyance means on the basis of the printing width set by the printing width setting means.

Through this configuration, the printing width in the conveyance direction of the region of the printing medium onto which the printing material is deposited by a single driving of the printing means is set to a width that corresponds to the size in the conveyance direction of the printing region that is specified based on the printing data. Driving of the printing means is controlled based on the printing width that is set as described above. The range of variation in the printing width in the conveyance direction of the region of the printing medium onto which the printing material is deposited by a single driving of the printing means can therefore be reduced in comparison with a case in which no consideration is made of the size in the conveyance direction of the printing region that is specified based on the printing data. As a result, it is possible to reduce the difference between the printing width in the conveyance direction of the region in which the printing material is deposited by the final driving of the printing means, and the printing width in the conveyance direction of the region in which the printing material is deposited by a single driving of the printing means previous to the final driving. Consequently, during printing on the printing medium, it is possible to reduce driving of the printing means in which there is no depositing of printing material onto the printing medium, and printing on the printing medium can therefore be performed more efficiently.

In the printing device of the invention, the print head has a plurality of nozzles for ejecting the printing material, each of which nozzles being arranged in the conveyance direction; the printing width setting means sets the number of candidate nozzles that can be used among the nozzles on the basis of the size of the printing region in the conveyance direction; and the printing control means controls the print head so that during printing based on acquired printing data, the printing material is ejected from the candidate nozzles set by the printing width setting means among the nozzles.

In a case in which there is a plurality of candidate nozzles, there are no nozzles besides the candidate nozzles between candidate nozzles that are mutually adjacent in the conveyance direction. The expression "in the conveyance direction" is not limited to directions parallel to the conveyance direction, and also includes directions which intersect the conveyance direction but are not orthogonal to the conveyance direction.

Through this configuration, it is possible to reduce the difference between the number of nozzles that can be used during depositing of the printing material onto the printing medium on the basis of the final driving of the printing means, and the number of nozzles that can be used during depositing of the printing material onto the printing medium on the basis of a driving of the printing means previous to the final driving, in comparison with a case in which no consideration is made of the size in the conveyance direction of the printing region that is specified based on the printing data.

In the printing device of the invention, the printing means further includes a moving body that moves in a reciprocating fashion in relation to the printing medium in a scanning direction that intersects the conveyance direction, the moving body supporting the print head; the printing control means is configured so as to control the printing means so that the printing material is deposited onto the printing medium while the moving body is moved in relative fashion from one side to the other side in the scanning direction, and subsequently to control the printing means so that the printing material is deposited onto the printing medium while the moving body is moved in relative fashion from the other side to the one side in the scanning direction; and the printing width setting means sets the printing width so that the number of times the moving body is moved is an even number during printing based on the printing data, on the basis of the size of the printing region in the conveyance direction.

In a case in which the number of movements of the moving body is set to an odd number, during the final driving of the printing means, the print head is driven while the moving body is moved in relative fashion to the other side in the scanning direction with respect to the printing medium. At the end of printing, the moving body is moved in relative fashion to the one side in the scanning direction with respect to the printing medium, and the printing means is then placed in a standby state. The final relative movement of the moving body to the one side in the scanning direction is a driving of the printing means in which there is no depositing of printing material onto the printing medium. In this respect, in the invention, the printing width in the conveyance direction of the region in which the printing material is deposited by a single driving of the printing means is set so that the number of movements of the moving body is an even number. Therefore, during the final driving of the printing means, the print head is driven while the moving body is moved in relative fashion to one side in the scanning direction with respect to the printing medium, and the printing means is then placed in a standby state. As a result, it is possible to reduce driving of the printing means in which there is no depositing of printing material onto the printing medium during printing on the printing medium.

The printing device of the invention further includes a printing material receiving part for receiving the printing material ejected from the print head; and maintenance control means (unit) for controlling the printing means so that the printing material is ejected from the print head into the printing material receiving part, in order to maintain precision of printing on the printing medium; wherein the maintenance control means places the printing material receiving part opposite the print head partway during printing on the printing medium, and causes the printing material to be ejected to the printing material receiving part from the first nozzle, while restricting ejection of the printing material to the printing material receiving part from the second nozzle.

The process (also referred to as "maintenance") for maintaining the precision of printing on the printing medium with respect to nozzles other than the candidate nozzles is a driving of the printing means in which there is no depositing of printing material onto the printing medium. In this respect, maintenance is not performed in the invention in nozzles other than the candidate nozzles. Consumption of the printing material that accompanies maintenance can therefore be reduced in comparison with a case in which maintenance is performed for the other nozzles as well.

The printing device of the invention further includes information acquisition means (unit) for acquiring, as the size of the printing region in the conveyance direction, at least one of a length in the conveyance direction of the printing medium on which printing is performed, a length in the conveyance direction of an image printed on the printing medium on the basis of the printing data, and a data length of the printing data; wherein the printing width setting means sets the printing width in the conveyance direction of a region of the printing medium onto which the printing material is deposited by a single driving of the printing means, on the basis of the results of acquisition by the information acquisition means.

Through this configuration, the printing width in the conveyance direction of the region in which the printing material is deposited by a single driving of the printing means is set based on at least one of the length in the conveyance direction of the printing medium on which printing is performed, the length in the conveyance direction of an image printed on the printing medium on the basis of the printing data, and the data length of the printing data.

The printing device of the invention includes acquisition means (unit) for acquiring printing data; a print head including a plurality of nozzles for ejecting a printing material; a movement mechanism for moving the print head in relation to a printing medium; selection means (unit) for selecting a candidate nozzle from the nozzles on the basis of the size of a printing region that is specified based on the printing data acquired by the acquisition means; and printing control means (unit) for controlling the driving of the print head and the movement mechanism so that the printing material is ejected from a candidate nozzle selected by the selection means during printing on the printing medium on the basis of the printing data acquired by the acquisition means.

Through this configuration, a candidate nozzle used during printing based on the printing data is selected based on the size of the printing region that is specified based on the printing data. The printing material is then ejected to the printing medium from the candidate nozzle thus set. The range of variation of the printing width of the region of the printing medium onto which the printing material is deposited by a single driving of the print head and the movement mechanism can therefore be reduced in comparison with a case in which no consideration is made of the size of the printing region that is specified based on the printing data. As a result, it is possible to reduce the difference between the printing width of the region in which the printing material is deposited by the final driving of the printing means, and the printing width of the region in which the printing material is deposited by a single driving of the print head previous to the final driving. Consequently, during printing on the printing medium, it is possible to reduce driving of the printing means in which there is no depositing of printing material onto the printing medium, and printing on the printing medium can therefore be performed more efficiently.

The printing method of the invention is a printing method for driving printing means (unit) on the basis of acquired printing data and thereby printing on a printing medium by using a printing material, the printing medium being conveyed in a predetermined conveyance direction; and the printing method includes a setting step of setting a printing width in the conveyance direction of a region of the printing medium onto which the printing material is deposited by a single driving of the printing means, on the basis of the size in the conveyance direction of a printing region that is specified based on the printing data; and a printing step of causing the printing material to be deposited onto the printing medium by the printing means and the printing medium to move in relative fashion in a predetermined conveyance direction, on the basis of the printing width set in the setting step.

Through this configuration, the same operations and effects can be obtained as by the printing device described above.

The printing method of the invention is a printing method for driving a print head on the basis of acquired printing data, and thereby printing on a printing medium by using a printing material; and the printing method includes a selection step of selecting a candidate nozzle from a plurality of nozzles provided to the print head, on the basis of the size of a printing region that is specified based on the printing data; and a printing step of causing printing that is based on the printing data to be performed on the printing medium, by ejecting the printing material from the candidate nozzle selected in the selection step.

Through this configuration, the same operations and effects can be obtained as by the printing device described above.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

A first embodiment of the invention will be described based on FIGS. 1 through 11.

Figure 1A:
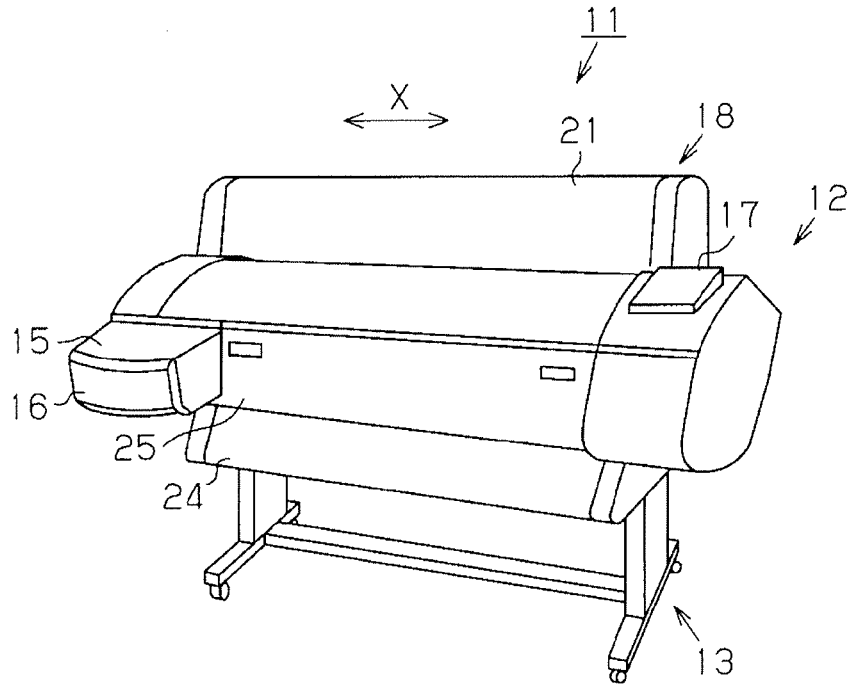
FIGS. 1A and 1B are rough perspective views showing the printing device according to a first embodiment.
Figure 1B:
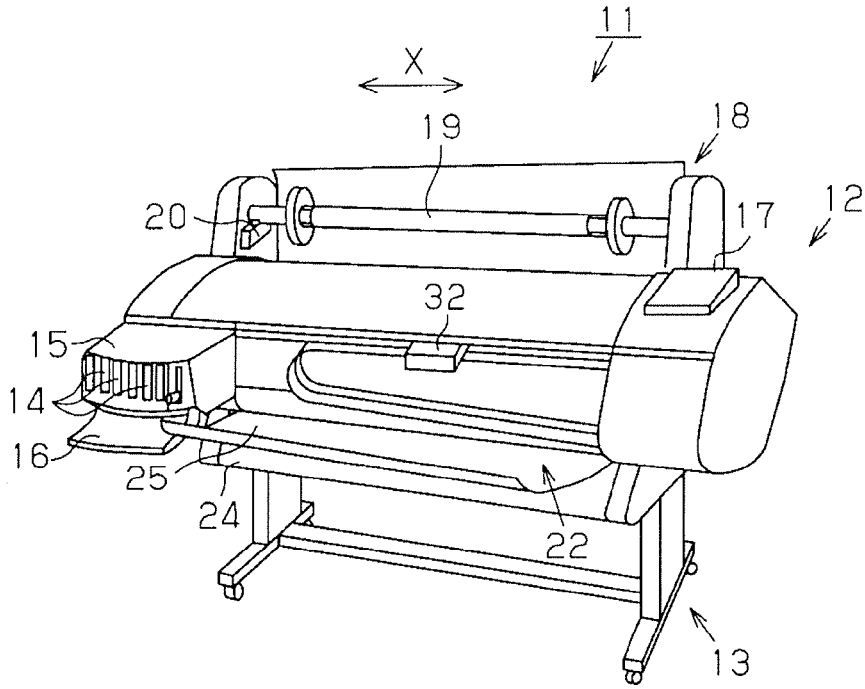

FIG. 1A is a perspective view showing an example of the configuration of the printing device of the present embodiment, and FIG. 1B is a perspective view showing an example of the internal configuration of the main parts of the printing device. As shown in FIGS. 1A and 1B, the printing device 11 is a serial-type inkjet printer for printing on roll-shaped printing paper P (also referred to hereinafter as "roll paper") as an example of the printing medium. The printing device 11 thus configured is provided with a printing device main body 12 for printing on the roll paper P, and a support stand 13 for supporting the printing device main body 12 from below in the gravity direction.

A holder part 15 for accommodating a plurality (six in the present embodiment) of ink cartridges 14, and a holder cover 16 for covering the holder part 15 from the front thereof, the holder cover 16 being capable of opening and closing, are provided on the left side of the printing device main body 12 as viewed from the front. An ink (printing material) of a different type (e.g., color) is accommodated in each of the ink cartridges 14. An operating panel 17 operated by a user is provided at the top on the right side of the printing device main body 12 as viewed from the front, and the operating panel 17 has a liquid crystal screen and various buttons.

A medium housing part 18 in which the roll paper P (see FIG. 3) is accommodated is provided at the top of the printing device main body 12. The roll paper P accommodated in the medium housing part 18 is wound onto a shaft member 19 which extends in the primary scanning direction X. Shaft supports 20 for supporting the shaft member 19 so that the shaft member 19 can rotate are provided on both sides in the primary scanning direction X inside the medium housing part 18. The shaft member 19 rotates in a predetermined rotation direction (indicated by an arrow in FIG. 3), and the roll paper P is thereby sent into the printing device main body 12 as a long paper. A removable housing cover 21 for covering the roll paper P accommodated inside the medium housing part 18 is provided on the front side of the medium housing part 18.

An ink ejection part 22 for ejecting ink to a portion of the roll paper P that is conveyed into the printing device main body 12, and a conveyance device 23 (see FIG. 3) as an example of conveyance means (unit) for conveying the roll paper P toward the ink ejection part 22 are provided inside the printing device main body 12. The printing device main body 12 is also provided with a paper ejection part 24 for ejecting the portion of the roll paper P on which ink is deposited by the ink ejection part 22, i.e., the portion on which printing is completed. The printing device main body 12 also has a main body cover 25 for covering the inside of the printing device main body 12, the main body cover 25 being capable of opening and closing.

The ink ejection part 22 will next be described.

Figure 2:
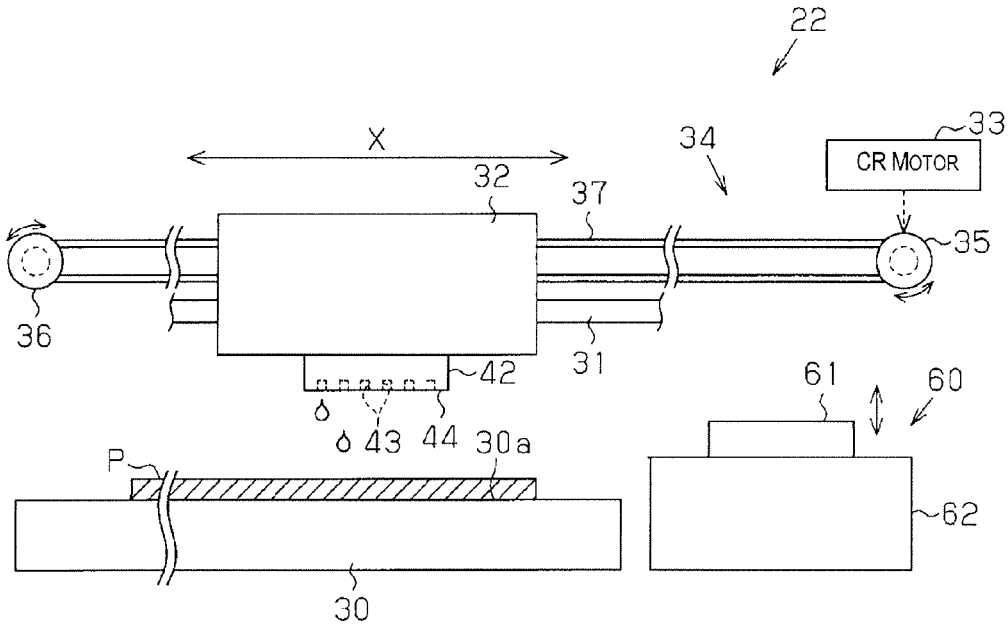
FIG. 2 is a schematic plan view showing the ink ejection part of the first embodiment.
Figure 3:
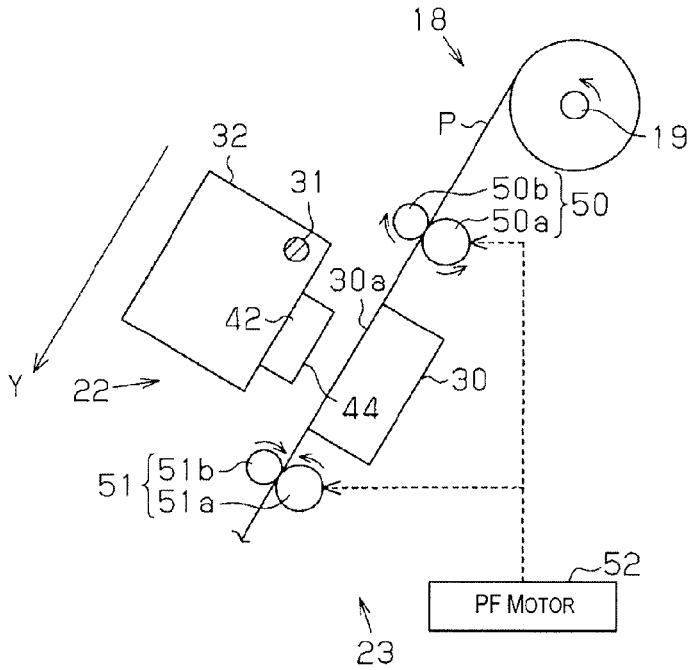
FIG. 3 is a schematic side view showing the ink ejection part and the conveyance device of the first embodiment.

As shown in FIGS. 2 and 3, the ink ejection part 22 is provided with a support member 30 which extends in the primary scanning direction X (left-right direction in FIG. 2). The support member 30 is disposed so that the upstream side (medium housing part 18 side) thereof in a secondary scanning direction (conveyance direction) Y which is substantially orthogonal to the primary scanning direction X is positioned further upward than the downstream side (paper ejection part 24 side). In other words, the support member 30 has a support surface 30*a* which is inclined with respect to the horizontal plane. The support surface 30*a* of the support member 30 thus configured supports the portion of the roll paper P that is conveyed into the printing device main body 12.

The ink ejection part 22 is provided with a guide shaft 31 which extends in the primary scanning direction X, and the guide shaft 31 is disposed facing the support surface 30*a* of the support member 30. The guide shaft 31 thus configured is supported so as to allow a carriage 32 to be moved in a reciprocating fashion in the primary scanning direction X.

The ink ejection part 22 is provided with a carriage motor (also referred to hereinafter as a "CR motor") capable of rotating in both the positive and negative directions, and a carriage drive part 34 for transmitting the drive force outputted from the CR motor 33 to the carriage 32. The carriage drive part 34 has a pair of pulleys 35, 36 supported so as to be able to rotate at both ends in the primary scanning direction X at a rear surface of the printing device main body 12, and an output shaft (not shown) of the CR motor 33 is coupled to one pulley 35 (on the right side in FIG. 2) so that drive force can be transmitted. An endless timing belt 37, a portion of which is coupled to the carriage 32, is suspended between the pair of pulleys 35, 36. The drive force from the CR motor 33 is transmitted via the carriage drive part 34, and the carriage 32 is thereby moved in the primary scanning direction X while being guided by the guide shaft 31. Consequently, in the present embodiment, the carriage drive part 34 functions as a movement mechanism for moving a print head 42 described hereinafter in relation to the roll paper P.

Figure 6:
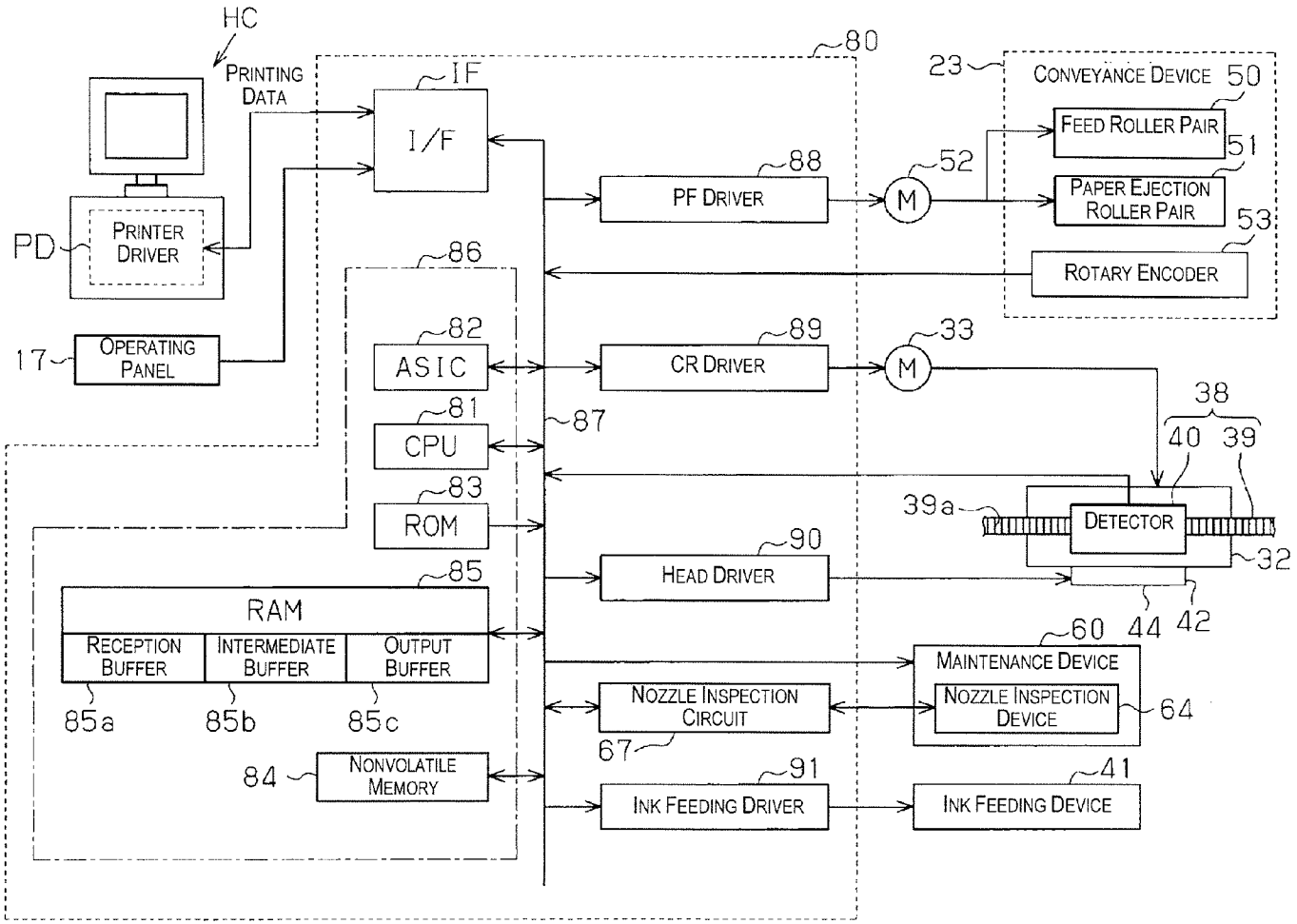
FIG. 6 is a block view showing the relevant parts of the electrical configuration of the printing device of the first embodiment.

A linear encoder 38 for detecting the, position in the primary scanning direction X, the movement speed, and the movement direction of the carriage 32 is provided on the rear surface side of the carriage 32. As shown in FIG. 6, the linear encoder 38 is provided with a detected tape 39 which extends in the primary scanning direction X, and a detector 40 which is supported by the carriage 32. The detected tape 39 is supported by the printing device main body 12 so as to be immobile, and the detected tape 39 has numerous slits 39*a* formed at equal intervals in the primary scanning direction X. The detector 40 has a plurality (e.g., two) of sensors (not shown) disposed in mutually different positions in the primary scanning direction X. A pulsed detection signal corresponding to the movement distance of the carriage 32 is outputted to a control circuit 80 (see FIG. 6) from each sensor of the detector 40.

A plurality (six in the present embodiment) of sub-tanks (not shown) for temporarily storing individual types of ink fed from the ink cartridges 14 is provided on the carriage 32. Ink from individually corresponding ink cartridges 14 is fed to the sub-tanks by the driving of an ink feeding device 41 (see FIG. 6).

A print head 42 is provided on the side of the carriage 32 that faces the support member 30, as shown in FIGS. 2 and 3. The print head 42 is provided with a plurality (only six of which are shown in FIG. 2) of nozzles 43 to which ink is fed from the sub-tanks, and a plurality of drive elements (e.g., piezoelectric elements) corresponding to individual nozzles 43 and not shown in the drawing. Ink fed from the sub-tanks is ejected (fed) toward the support member 30 from the nozzles 43 by the driving of the drive elements. Consequently, in the present embodiment, the print head 42 and the carriage 32 constitute a printing means (unit) for causing ink to be deposited onto the portion of the roll paper P that is conveyed to the ink ejection part 22.

Figure 4:
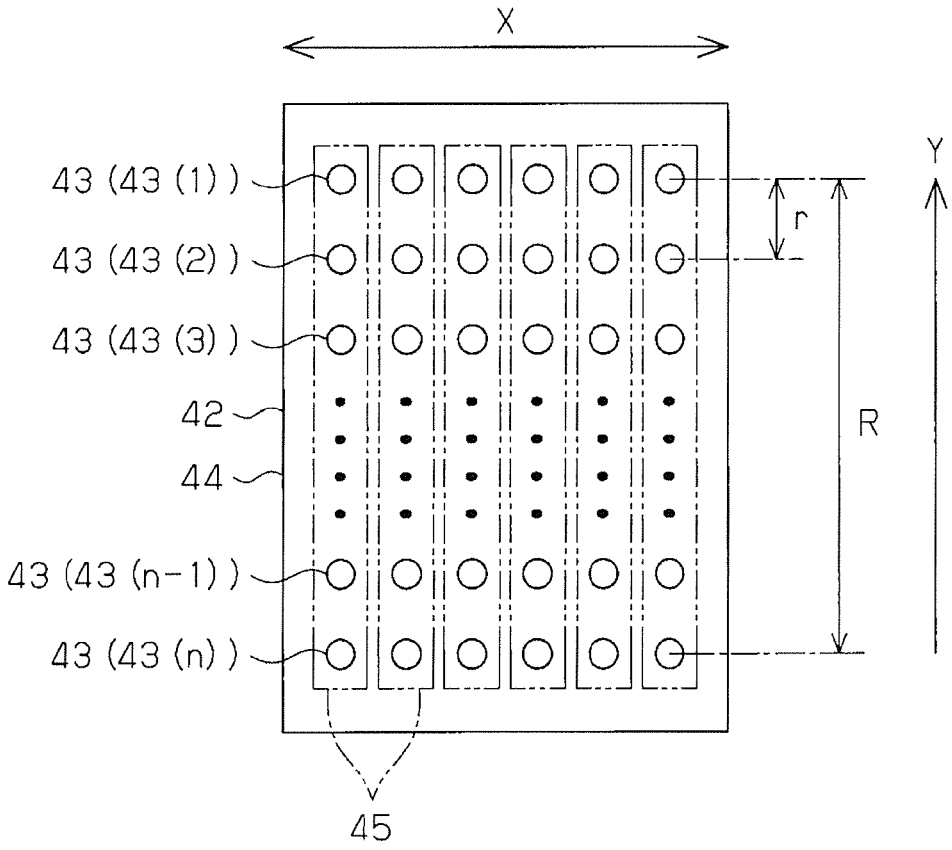
FIG. 4 is a schematic plan view showing the nozzle formation surface.

As shown in FIG. 4, the facing surface of the print head 42 that faces the support member 30 is a nozzle formation surface 44 in which the nozzles 43 are formed, and a plurality (six in the present embodiment) of nozzle rows 45 (portions surrounded by double-dashed lines in FIG. 4) extending in the secondary scanning direction Y is formed in the nozzle formation surface 44. Each nozzle row 45 corresponds to an individual ink cartridge 14, and the nozzle rows 45 are disposed at predetermined intervals in the primary scanning direction X. The nozzle rows 45 are also formed by n (e.g., 360) nozzles 43 disposed at a predetermined nozzle pitch r interval in the secondary scanning direction Y, and the length of the nozzle rows 45 in the secondary scanning direction Y is set to a head length R. The nozzles 43 constituting the nozzle rows 45 are assigned lower numbers the further downstream in the secondary scanning direction Y. Specifically, nozzle 43 (1) is positioned further toward the paper ejection part 24 than nozzle 43 (3).

Figure 5:
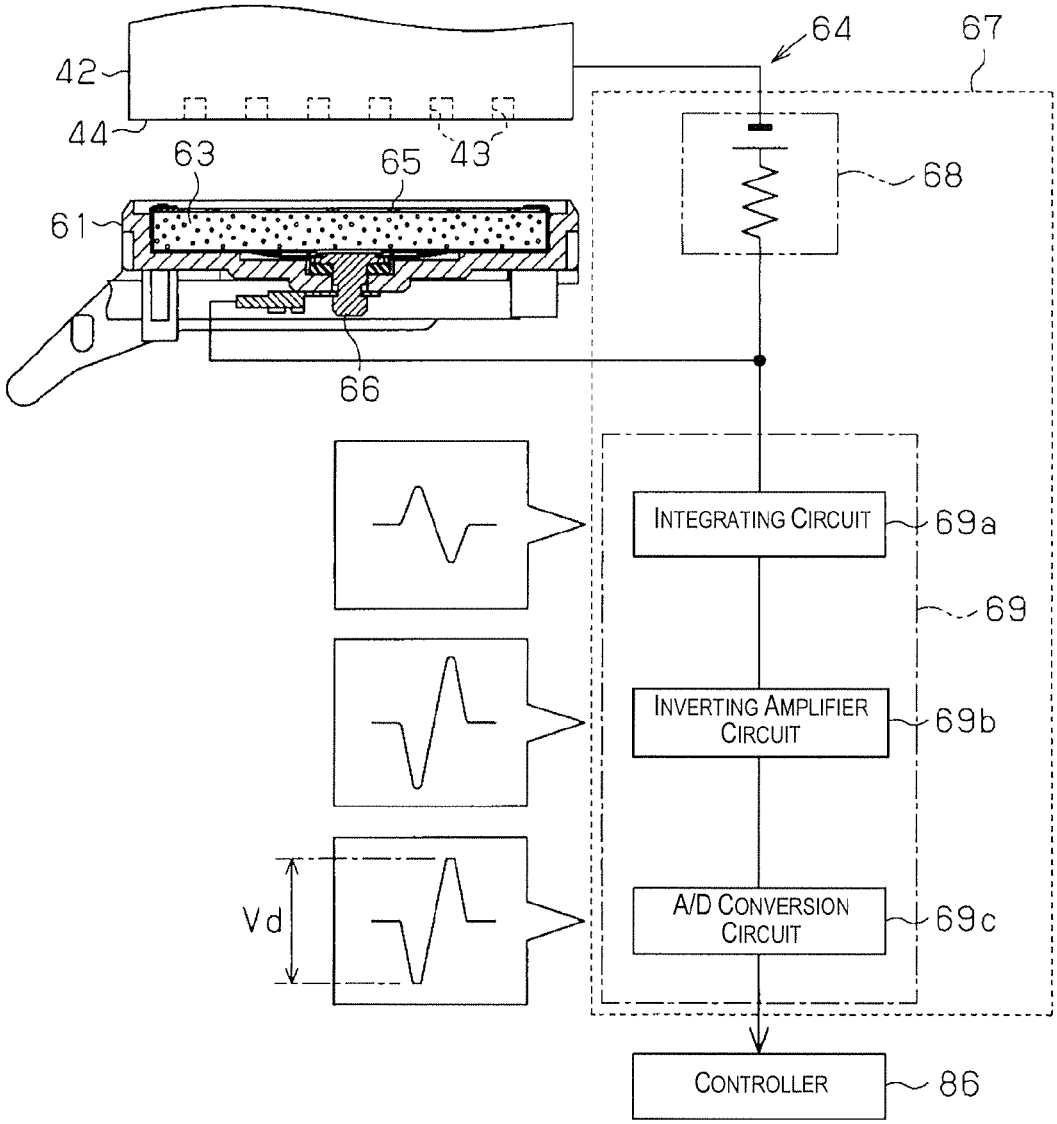
FIG. 5 is a schematic view showing the nozzle scanning device.

As shown in FIG. 2, a home position to which the roll paper P is not fed is formed on one side (right side in FIG. 2) in the primary scanning direction X of the support member 30, and a maintenance device 60 for performing various types of maintenance on the print head 42 to maintain the precision of printing on the roll paper P is provided at the home position. The maintenance device 60 is provided with a substantially cylindrical cap (printing material receiving part) 61 having a bottom, which moves toward and away (in the vertical direction in FIG. 2, orthogonal to the support surface 30*a*) from the print head 42 positioned at the home position, and a raising and lowering mechanism 62 for raising and lowering the cap 61. The maintenance device 60 is also provided with a suction pump (not shown) for discharging the ink (waste ink) received in the cap 61 to a waste ink tank not shown in the drawing. As shown in FIG. 5, the cap 61 is disposed so as to be open on the side facing the print head 42, and an ink absorbing material 63 for absorbing the ink (also referred to as waste ink) ejected (discharged) from the print head 42 positioned at the home position is accommodated in the cap 61.

The maintenance device 60 of the present embodiment is provided with a nozzle inspection device 64 for detecting a defective nozzle among the nozzles 43. A defective nozzle is a nozzle from which ink cannot be ejected, due to such causes as an increase in viscosity of the ink in the nozzle, or a nozzle from which the amount of ink instructed from the control circuit 80 described hereinafter cannot be ejected.

The nozzle inspection device 64 is provided with a metal net material (electrode part) 65 for covering the top surface (surface on the side facing the print head 42) of the ink absorbing material 63 in the cap 61, and a plus-side terminal 66 disposed at the center of the bottom part of the cap 61, and the net material 65 is electrically connected to the plus-side terminal 66. A nozzle inspection circuit 67 (portion surrounded by dashed lines in FIG. 5) is electrically connected to the nozzle inspection device 64. The nozzle inspection circuit 67 is provided with a voltage application circuit 68 for applying a voltage across the net material 65 and the nozzle formation surface 44 of the print head 42, and a voltage detection device 69 for detecting a variation of the voltage value across the net material 65 and the nozzle formation surface 44. The voltage application circuit 68 is provided with a direct-current power supply (e.g., 400 V) and a resistor element (e.g., 1 MΩ) so that the net material 65 is the positive electrode and the nozzle formation surface 44 is the negative electrode. The surface (top surface in FIG. 5) of the net material 65 facing the print head 42 therefore takes a positive charge, and the nozzle formation surface 44 of the print head 42 takes a negative charge.

The voltage detection device 69 is provided with an integrating circuit 69*a* for integrating a detection signal from the net material 65 and outputting the result; an inverting amplifier circuit 69*b* for inverting and amplifying the signal outputted from the integrating circuit 69*a* and outputting the result; and an A/D conversion circuit 69*c* for applying A/D conversion to the signal outputted from the inverting amplifier circuit 69*b* and outputting the result to a controller 86.

During nozzle scanning by the nozzle inspection device 64, ink is ejected into the cap 61 from the nozzles 43 being inspected. At this time, a negative charge is imparted to the ink ejected from the nozzles 43. As the ink thus charged approaches the net material 65, a positive charge gradually increases in the net material 65 due to electrostatic induction. As a result, the potential difference between the net material 65 and the nozzle formation surface 44 of the print head 42 increases in comparison with a case in which ink is not ejected from the nozzles 43, due to an induced voltage based on electrostatic induction.

When the ink lands on the net material 65, a portion of the positive charge of the net material 65 is neutralized by the negative charge of the ink. The potential difference (voltage) between the net material 65 and the nozzle formation surface 44 of the print head 42 then decreases in comparison to a case in which ink is not ejected from the nozzles 43. The potential difference between the net material 65 and the nozzle formation surface 44 of the print head 42 subsequently returns to the initial size thereof. A detection signal relating to this potential difference is inputted to the controller 86 via the integrating circuit 69*a*, the inverting amplifier circuit 69*b*, and the A/D conversion circuit 69*c*.

The amplitude Vd (amount of variation of the voltage value between the net material 65 and the nozzle formation surface 44 of the print head 42) of the detection signal inputted from the A/D conversion circuit 69*c* is then detected by the controller 86. When the detected amplitude Vd is equal to or greater than a pre-set amplitude threshold value, a determination is made that the nozzles 43 being inspected are normal, and when the detected amplitude Vd is less than the amplitude threshold value, a determination is made that the nozzles 43 being inspected are defective.

The conveyance device 23 will next be described.

As shown in FIG. 3, the conveyance device 23 is a device for conveying the roll paper P in the secondary scanning direction Y. The conveyance device 23 is provided with a feed roller pair 50 disposed on the upstream side (at the top and inclined to the right, on the medium housing part 18 side in FIG. 3) of the support member 30 in the secondary scanning direction Y, and a paper ejection roller pair 51 disposed on the downstream side (at the bottom and inclined to the left in FIG. 3) of the support member 30 in the secondary scanning direction Y. The feed roller pair 50 and the paper ejection roller pair 51 are each composed of drive rollers 50*a*4, 51*a* rotated by drive force transmitted from a paper feed motor (also referred to hereinafter as a "PF motor") 52, and driven rollers 50*b*, 51*b* which are rotated in conjunction with the rotation of the drive rollers 50*a*, 51*a*. The rotation speed, rotation amount, rotation direction, and other parameters of the PF motor 52 are controlled through the use of a rotary encoder 53 (see FIG. 6) provided in the vicinity of the output shaft of the PF motor 52. The drive rollers 50*a*, 51*a* are rotated in the direction of the arrow shown in FIG. 3 by the drive force transmitted from the PF motor 52, and the roll paper P held between the roller pairs 50, 51 is thereby fed (conveyed) toward the paper ejection part 24 in the secondary scanning direction Y.

The term "convey the roll paper P" in the present embodiment refers to the sending of the roll paper P as a long paper by the rotation of the shaft member 19 in a predetermined direction (indicated by an arrow in FIG. 3) within the medium housing part 18.

The electrical configuration of the printing device 11 will next be described.

As shown in FIG. 6, a host device HC is connected to the printing device 11 via a communication cable. In other words, the control circuit 80 of the printing device 11 is capable of transmitting and receiving printing data and various other types of information with the host device HC via an interface IF. Operation information relating to the results of user operation of the operating panel 17 is inputted to the interface IF of the control circuit 80.

A printer driver PD for generating printing data is constructed in the host device HC by a program and the CPU (not shown) of the host device HC. The printing data include a command and image data which relate to the image to be printed on the roll paper P. The printer driver PD converts the resolution of the image data to the printing resolution of the printing device 11 and applies color conversion processing to the converted image data. The printer driver PD then applies halftone processing (gradation conversion processing) to the image data for which color conversion processing is finished. The printer driver PD then generates printing data which include the image data to which the various types of processing described above have been applied, and transmits the generated printing data to the printing device 11. At this time, the printer driver PD can transmit data to the printing device 11 without performing some of the processing described above, depending on the filename extension of the printing data.

The printer driver PD also divides the printing data into a plurality of units and transmits the divided printing data in sequence to the printing device 11. In other words, the printer driver PD first transmits data relating to printing conditions which are set at the host device HC to the printing device 11. The printing conditions include a printing scheme (bidirectional printing or unidirectional printing), the amount of each paper feeding (conveyance amount), the size of the printing medium, the width of the margins in the printing medium, and other conditions.

The printer driver PD then divides the printing data into amounts of data (also referred to hereinafter as "divided printing data") commensurate with a single scan of the carriage 32, and transmits the divided printing data in sequence to the printing device 11. As described in detail hereinafter, the printer driver PD transmits the data relating to the printing conditions, and subsequently receives a reply composed of information relating to the data length Ds (see FIG. 7) from the printing device 11. The printer driver PD generates divided printing data having the data length Ds instructed from the printing device 11, and transmits the generated divided printing data in sequence to the printing device 11. The final (used for the final pass) divided printing data includes end information for instructing to end printing.

The control circuit 80 of the printing device 11 will next be described.

The control circuit 80 is provided with a controller 86 (portion surrounded by a dotted line in FIG. 4) having a CPU 81, an ASIC 82 ((Application Specific IC (IC for a specific application)), a ROM 83, a nonvolatile memory 84, and a RAM 85. The controller 86 is electrically connected to the nozzle inspection circuit 67 and various drivers 88, 89, 90, 91 via a bus 87. The controller 86 controls the PF motor 52 via a PF driver 88, and controls the CR motor 33 via a CR driver 89. The controller 86 also controls the print head 42 (specifically, the drive elements within the print head 42) via a head driver 90, and controls the ink feeding device 41 via an ink feeding driver 91.

Various control programs and various data are stored in the ROM 83. Various programs such as firmware programs, and various data necessary for printing are stored in the nonvolatile memory 84. Data of programs executed by the CPU 81, various data constituting the results of computation and processing by the CPU 81, and various data processed by the ASIC 82 are temporarily stored in the RAM 85. The RAM 85 also has a reception buffer 85*a*, an intermediate buffer 85*b*, and an output buffer 85*c*. Printing data (i.e., divided printing data) received from the host device HC are stored in the reception buffer 85*a*, and data for which processing is in progress are stored in the intermediate buffer 85*b*. Processed data are stored in the output buffer 85*c*.

The controller 86 of the present embodiment will next be described.

Figure 7:
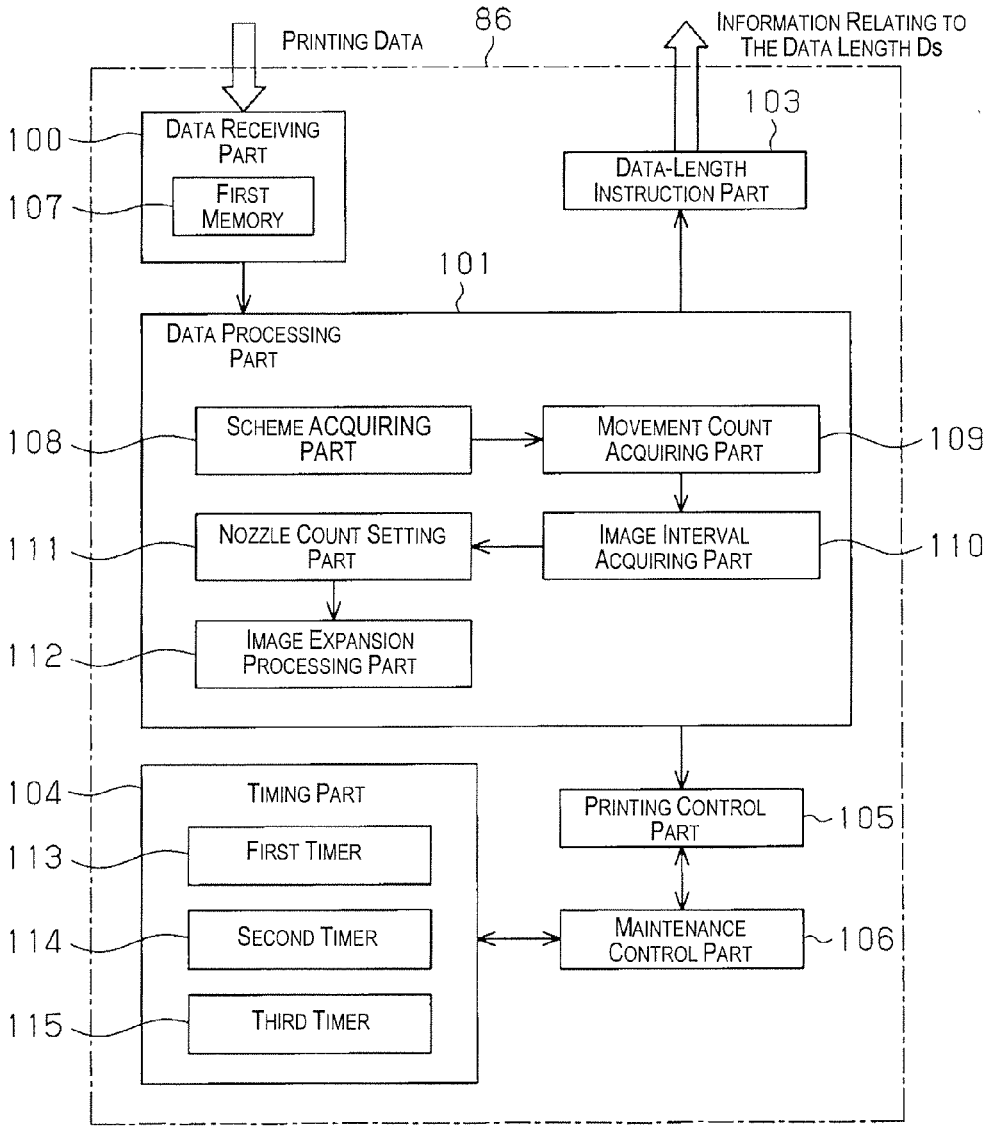
FIG. 7 is a block view showing the relevant parts of the functional configuration of the controller.

As shown in FIG. 7, the controller 86 is provided with a data receiving part 100, a data processing part 101, a data-length instruction part 103, a timing part 104, a printing control part 105, and a maintenance control part 106 as functional portions realized by at least one of hardware and software.

The data receiving part 100 is provided with a first memory 107 for temporarily storing data (data relating to printing conditions, divided printing data, and other data) received from the host device HC. The first memory 107 is configured so as to include the reception buffer 85*a*. The data receiving part 100 outputs, to the data processing part 101, the data temporarily stored (stored) in the first memory 107. Consequently, in the present embodiment, the data receiving part 100 functions as an acquisition means (unit) for acquiring the printing data.

The data processing part 101 is provided with a scheme acquiring part 108, a movement count acquiring part 109, an image interval acquiring part 110, a nozzle count setting part 111, and an image expansion processing part 112. The scheme acquiring part 108 acquires the printing mode set at the host device HC, on the basis of data relating to printing conditions that is received by the data receiving part 100. The scheme acquiring part 108 then determines, based on the acquired printing mode, whether the printing scheme performing in the current printing is the bidirectional printing scheme or the unidirectional printing scheme. For example, when the printing mode is draft printing, the scheme acquiring part 108 determines that the printing scheme is the bidirectional printing scheme, and when the printing mode is high-detail printing, the scheme acquiring part 108 determines that the printing scheme is the unidirectional printing scheme. The scheme acquiring part 108 outputs information relating to the acquired printing scheme to the movement count acquiring part 109.

Figure 8B:
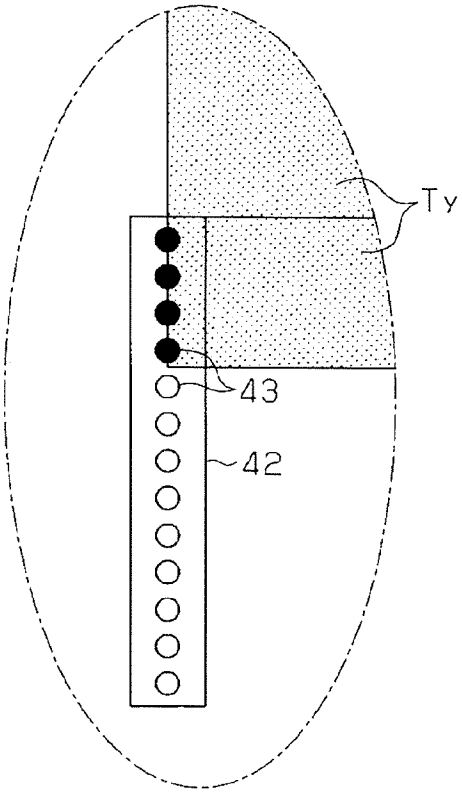
FIG. 8B is an enlarged view of a portion of FIG. 8A.
Figure 8A:
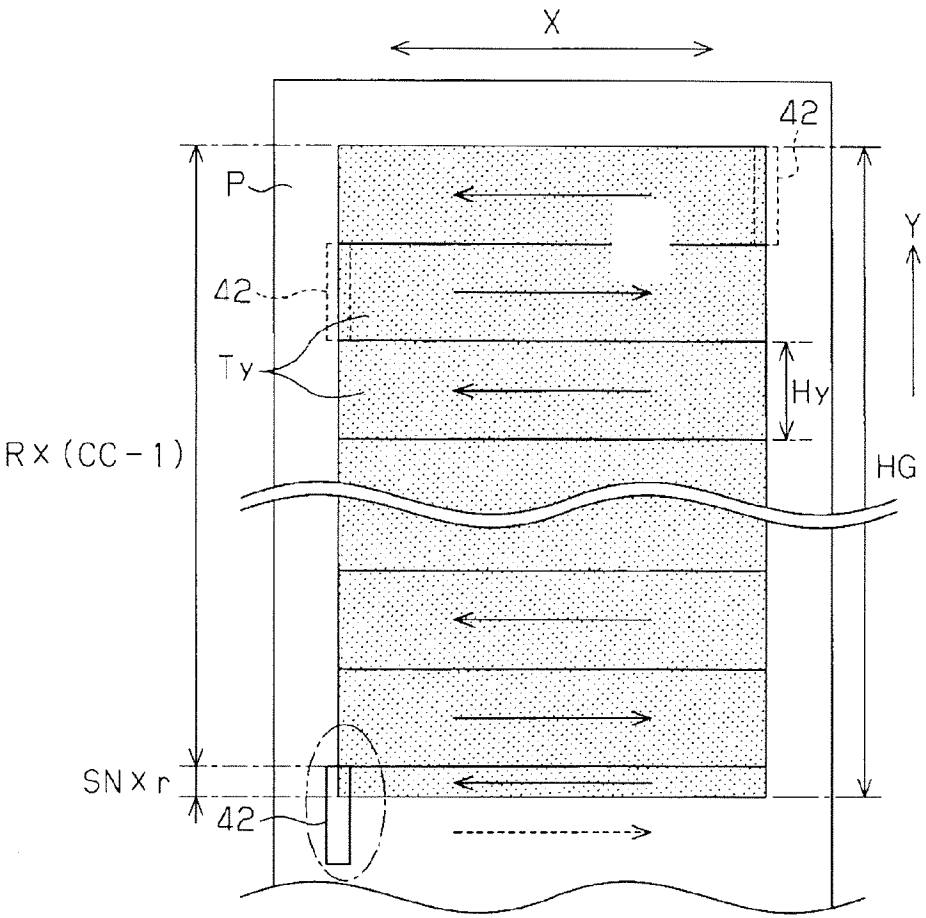
FIG. 8A is an operation view showing the manner in which printing is performed in the known method.

The "bidirectional printing scheme" is a printing scheme in which ink is ejected from the print head 42 when the carriage 32 moves in the forward direction (to the left in FIG. 8A), and ink is also ejected from the print head 42 when the carriage 32 moves in the reverse direction (to the right in FIG. 8A), as shown in FIG. 8A. The "unidirectional printing scheme" is a printing scheme in which ink is ejected from the print head 42 only when the carriage 32 moves in the forward direction.

As shown in FIG. 7, the movement count acquiring part 109 has a counter (not shown) for counting the number of movements (number of scans) of the carriage 32 that occur in the primary scanning direction X before a single page of printing is completed during printing based on the printing data. In a case in which the printing scheme is the bidirectional printing scheme, the movement count acquiring part 109 counts during movement of the carriage 32 in the forward direction, as well as during movement of the carriage 32 in the reverse direction (see FIG. 8). In a case in which the printing scheme is the unidirectional printing scheme, the movement count acquiring part 109 counts during movement of the carriage 32 in the forward direction, but not during movement of the carriage 32 in the reverse direction. In other words, the movement count acquiring part 109 counts the number of movements of the carriage 32 that are accompanied by ink ejection to the roll paper P. When one page of printing is completed, the movement count acquiring part 109 outputs information related to the count value to the image interval acquiring part 110 and resets the count value to "0 (zero)."

The image interval acquiring part 110 acquires information relating to the count value from the movement count acquiring part 109. The image interval acquiring part 110 also acquires, information from the printing control part 105 that relates to a used nozzle count SN for the final movement of the carriage 32 that accompanies ink ejection. The used nozzle count SN is a number corresponding to the printing width in the secondary scanning direction Y of the region last to be printed. The image interval acquiring part 110 then computes, based on the acquired information, the length HG in the secondary scanning direction Y of the image printed on the roll paper P, by using the relational expression (Equation 1) shown below. The image interval acquiring part 110 then outputs information relating to the acquired length HG to the nozzle count setting part 111. Consequently, in the present embodiment, the image interval acquiring part 110 functions as information acquisition means (unit). The length HG can also be acquired based on data relating to the printing conditions received by the data receiving part 100.

In the relational expression (Equation 1), the portion "R×(CC−1)" is the result of computing the printing width in the secondary scanning direction Y of the portion on which ink is deposited by ink ejection using all of the nozzles 43 that constitute a single nozzle row 45. The portion "SN×r" is the result of computing the printing width in the secondary scanning direction Y of the portion on which ink is deposited by the final ink ejection.

$$HG=R\times(CC-1)+SN\times r \quad \text{[Eq. 1]}$$

HG: Length of the image in the secondary scanning direction Y; R: Head length; CC: Count value (number of movements of the carriage 32 that accompany ink ejection); SN: Used nozzle count; r: Nozzle pitch The used nozzle count SN will be described based on FIGS. 8A and 8B. A band printing scheme in which all of the nozzles 43 are used for printing is assumed to be set on the printer driver PD side. For the sake of convenience in understanding the description given in this specification, the print head 42 in FIG. 8B has a single nozzle row 45, and the nozzle row 45 is composed of thirteen nozzles 43.

In this case, the printer driver PD transmits, to the printing device 11, divided printing data which are generated so that data are allocated to all of the nozzles 43 constituting the nozzle row 45. During movements other than the final movement of the carriage 32, ink is then ejected to the roll paper P from all of the nozzles 43 constituting the nozzle row 45, as shown in FIG. 8A. During the final movement of the carriage 32, however, only a portion (those indicated by black circles in FIG. 8B) of all the nozzles 43 are used, as shown in FIG. 8B. The number of nozzles 43 used during the final movement of the carriage 32, i.e., the used nozzle count SN (four in FIG. 8B), can sometimes be half or less of the total number of nozzles (thirteen in this instance).

As shown in FIG. 7, the nozzle count setting part 111 acquires information relating to the length HG from the image interval acquiring part 110. In a case in which the printing scheme is the band printing scheme, the nozzle count setting part 111 uses the relational expression (Equation 2) shown below to compute the number of movements of the carriage 32 that are accompanied by ink ejection, i.e., the printing pass count IP, in the second and subsequent pages. In a case in which the length HG cannot be divided by the head length R, the nozzle count setting part 111 rounds up after the decimal point of the printing pass count IP computed by the relational expression (Equation 2). In a case in which the printing scheme is the bidirectional printing scheme, the nozzle count setting part 111 increments the printing pass count IP by "1" when the printing pass count IP is an odd number. In other words, in a case in which the printing scheme is the bidirectional printing scheme, the printing pass count IP is set to an odd number.

$$IP=HG\div R \quad \text{[Eq. 2]}$$

IP: Printing pass count; HG: Length of the image in the secondary scanning direction Y; R: Head length The nozzle count setting part 111 then sets the candidate nozzle count KN by substituting the computed printing pass count IP into the relational expression (Equation 3) shown below. At this time, the nozzle count setting part 111 rounds up after the decimal point in cases in which the candidate nozzle count KN computed by the relational expression (Equation 3) includes a number after the decimal point, and sets the resultant numerical value as the candidate nozzle count KN. A "candidate nozzle" is a nozzle that can be used during printing based on the printing data, and the "candidate nozzle count KN" is the number of nozzles set as candidate nozzles among the nozzles 43 of a single nozzle row 45. The nozzles (also referred to as "unused nozzles") other than the candidate nozzles are not used during printing.

$$KN=(HG\div IP)\div r \quad \text{[Eq. 3]}$$

KN: Candidate nozzle count; HG: Length of the image in the secondary scanning direction Y; IP: Printing pass count; r: Nozzle pitch In a case in which the candidate nozzle count KN is more than one in the present embodiment, the nozzles are arranged so that unused nozzles are not positioned between candidate nozzles that are mutually adjacent in the secondary scanning direction Y. In other words, the candidate nozzles are all arranged so as to be adjacent to each other. Therefore, by acquiring the candidate nozzle count KN, the printing width Hy (=KN×r) in the secondary scanning direction Y of the region (also referred to hereinafter as the "single scan region") Ty of the roll paper P onto which ink is deposited by a single movement of the carriage 32 is set (see FIG. 11). The nozzle count setting part 111 outputs information relating to the computed candidate nozzle count KN to the image expansion processing part 112. Consequently, in the present embodiment, the nozzle count setting part 111 functions as printing width setting means (unit). The nozzle count setting part 111 also selects candidate nozzles from the nozzles 43 on the basis of the length HG of the image in the secondary scanning direction Y, and thus also functions as selection means (unit).

The image expansion processing part 112 converts the data not including a command from the divided printing data stored in the first memory 107 of the data receiving part 100 into bitmap data in which printing dots are indicated by gradation values, and expands the bitmap data. The image expansion processing part 112 then generates a single scan of bitmap data on the basis of the expanded data. At this time, the image expansion processing part 112 generates a single scan of bitmap data so that data based on the received divided printing data are allocated to the candidate nozzles, and dummy data (null data) are allocated to the unused nozzles. When an instruction is inputted from the printing control part 105, the image expansion processing part 112 outputs the generated single scan of bitmap data to the printing control part 105. A "single scan of bitmap data" is the data necessary for ejecting ink to the roll paper P during a single movement of the carriage 32 in the primary scanning direction X, i.e., a single driving of the printing means.

When information relating to the candidate nozzle count KN is acquired from the nozzle count setting part 111, the data-length instruction part 103 computes a data length Ds on the basis of the relational expression (Equation 4) shown below, wherein the data length Ds is longer the greater the acquired candidate nozzle count KN is. The data-length instruction part 103 then transmits information relating to the computed data length Ds to the host device HC. The "maximum data count Dmax necessary for a single nozzle" is the data count necessary for a single nozzle, or the maximum data count necessary for a single nozzle in a single scan of the carriage 32 in a case in which ink is continuously ejected in a single scan of the carriage 32 (i.e., in the case of so-called solid printing), for example. The "data length Ds" is an item of data for specifying the size, i.e., the data length, of the divided printing data transmitted from the printer driver PD side. When the data length Ds set herein is transmitted to the printer driver PD side, the printer driver PD generates divided printing data having the set data length Ds, and transmits the divided printing data to the printing device 11.

$$Ds=D\,max\times RN \quad \text{[Eq. 4]}$$

Ds: Data length; Dmax: Maximum data count necessary for a single nozzle; KN: Candidate nozzle count; RN: Number of nozzle rows (=number of colors)

The timing part 104 is provided with a first timer 113, a second timer 114, and a third timer 115. These timers 113 through 115 are each composed of a clock circuit or the like. The first timer 113 is a timer for clocking the interval for flushing, which is a type of maintenance processing. The second timer 114 is a timer for clocking the interval for the nozzle scanning processing described above, which is a type of maintenance processing. The third timer 115 is a timer for clocking the interval for cleaning, which is a type of maintenance processing. In a case in which an instruction is issued from the maintenance control part 106 described hereinafter, the timing part 104 outputs, to the maintenance control part 106, information relating to the time clocked by the timer (e.g., the first timer 113) that corresponds to the instruction.

The printing control part 105 outputs a data output instruction to the data processing part 101. The printing control part 105 controls the CR motor 33, the print head 42 (specifically, the drive elements housed in the print head 42), and the PF motor 52 on the basis of the single scan of bitmap data inputted from the data processing part 101, and printing is thereby applied to the roll paper P. Consequently, in the present embodiment, the printing control part 105 functions as printing control means (unit). In a case in which generation of the single scan of bitmap data for performing the next ink ejection control has not been completed by the data processing part 101, the printing control part 105 places the carriage 32 (and the print head 42) in a standby state until generation is completed.

The maintenance control part 106 subjects the candidate nozzles to flushing in a case in which the time clocked by the first timer 113 exceeds a pre-set first reference value. The maintenance control part 106 subjects the candidate nozzles to nozzle inspection in a case in which the time counted by the second timer 114 exceeds a pre-set second reference value. When a defective nozzle is found to be present as a result, flushing or cleaning is performed to restore the defective nozzle. The maintenance control part 106 also subjects the candidate nozzles to cleaning in a case in which the time clocked by the third timer 115 exceeds a pre-set third reference value. In other words, the maintenance control part 106 periodically or non-periodically executes flushing, nozzle inspection, and other maintenance processing in order to maintain the precision of printing on the roll paper P. The maintenance control part 106 therefore functions as maintenance control means (unit) in the present embodiment. In the present embodiment, since maintenance is performed for the candidate nozzles and not for other nozzles, the time needed for maintenance can be reduced.

The printing routines executed by the controller 86 of the present embodiment will next be described based on the flowchart shown in FIG. 9 and the timing chart shown in FIG. 10.

The printing routines are executed when printing data begins to be received from the host device HC. In the first step S10, the controller 86 performs printing initiation processing. Specifically, the controller 86 controls the PF motor 52 so that the distal end of the roll paper P advances into the ink ejection part 22.

In the next step S11, the controller 86 determines whether the printing is that of the second page. In a case in which the printing is that of the first page, or of the third or subsequent page (step S11: NO), the processing by the controller 86 transitions to step S13 described hereinafter. In a case in which the printing is that of the second page (step S11: YES), the controller 86 transitions the processing to the next step S12.

In step S12, the controller 86 performs candidate-nozzle-count setting for setting the candidate nozzle count KN. In other words, the controller 86 computes the candidate nozzle count KN by substituting the used nozzle count SN, the counting value CC, and other values acquired during printing of the first page into the relational expressions (Equations 1 through 3) described above. The controller 86 also computes the data length Ds by substituting the computed candidate nozzle count KN into the relational expression (Equation 4) described above, and transmits information relating to the computed data length Ds to the host device HC. The processing by the controller 86 then transitions to the next step S13.

In step S13, the controller 86 performs maintenance processing for maintaining the precision of printing on the roll paper P. Specifically, in a case in which maintenance processing is performed for the first time in the execution of the current printing routines, the controller 86 acquires each time clocked by the timers 113 through 115. The controller 86 then performs processing for flushing, nozzle inspection, and cleaning as needed.

In the case of the second and subsequent maintenance processing, the controller 86 acquires the time clocked by the first timer 113 and performs flushing as needed. In other words, even when nozzle inspection and cleaning are executed immediately prior to the start of ink ejection to the roll paper P, nozzle inspection and cleaning are not executed once ink ejection to the roll paper P is initiated. In the present embodiment, in a case in which flushing or nozzle inspection is performed, the controller 86 performs flushing or nozzle inspection for the candidate nozzles set in the processing of step S12, but does not perform flushing or nozzle inspection for the unused nozzles.

The controller 86 then performs ink ejection (step S14) and paper feed processing (step S15). Steps S14 and S15 therefore constitute printing steps in the present embodiment.

In the ink ejection, the printing control part 105 controls the movement of the carriage 32 and controls the ejection of ink from the candidate nozzles of the nozzles 43 of the print head 42, on the basis of the single scan of bitmap data generated by the data processing part 101. The ink ejection can be executed so as to start driving of the CR motor 33 before driving of the PF motor 52 is stopped, so that ink ejection by the print head 42 is performed immediately after or at the same time as the end of the paper feed processing.

In the paper feed processing, the printing control part 105 controls the PF motor 52 on the basis of the paper feed amount set on the printer driver PD side. In this paper feed processing, in a case in which the printing scheme is the bidirectional printing scheme, the feed roller pair 50 and the paper ejection roller pair 51 are driven immediately after the end of ink ejection from the print head 42 (or immediately after movement of the carriage 32 is temporarily stopped). In a case in which the printing scheme is the unidirectional printing scheme, in the paper feed processing, the feed roller pair 50 and the paper ejection roller pair 51 are driven while the carriage 32 is moving in the reverse direction upon completion of ink ejection.

In the next step S16, the controller 86 determines whether the current printing has ended. In other words, end information for instructing to end printing is included in the divided printing data transmitted last among the units of divided printing data that are transmitted from the host device HC. The controller 86 therefore determines whether ink ejection based on divided printing data that include end information is completed. In a case in which the current printing is not ended (step S16: NO), the processing by the controller 86 transitions to the aforementioned step S11 so as to continue the printing, and in a case in which the current printing is ended (step S16: YES), the processing by the controller 86 transitions to the next step S17.

Figure 10:
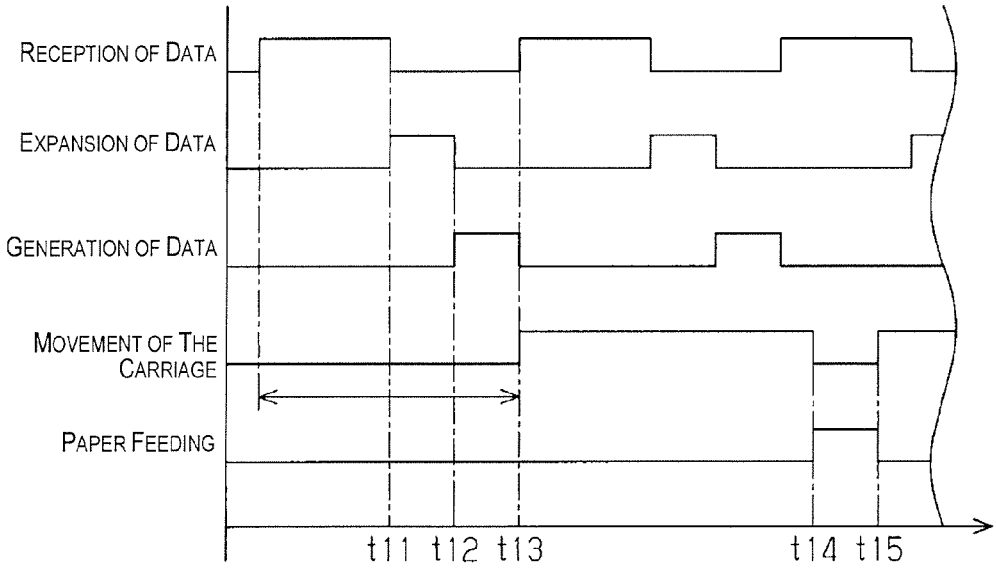
FIG. 10 is a timing chart showing the timing of data conversion and printing during printing.

As shown in the timing chart of FIG. 10, when reception of divided printing data is completed, the divided printing data thus received are expanded by the image expansion processing part 112 (first timing t11). When expansion of the divided printing data is completed, generation of a single scan of bitmap data is initiated by the image expansion processing part 112 (second timing t12). When generation of a single scan of bitmap data is completed, the next divided printing data begin to be received by the data receiving part 100 (third timing t13). Reception, expansion, and generation of data are thus repeated.

At the third timing t13, movement of the carriage 32 is initiated so that ink is ejected onto the roll paper P, and ink is ejected from the print head 42 at the appropriate timing. When movement of the carriage 32, i.e., ink ejection, is subsequently completed, the paper feed processing is initiated (fourth timing t14). At the fifth timing t15 at which paper feed processing is completed, in a case in which generation of the next single scan of bitmap data is completed, movement of the carriage 32 and ejection of ink from the print head 42 are immediately initiated. Ink ejection and paper feed processing are thus repeated.

Figure 9:
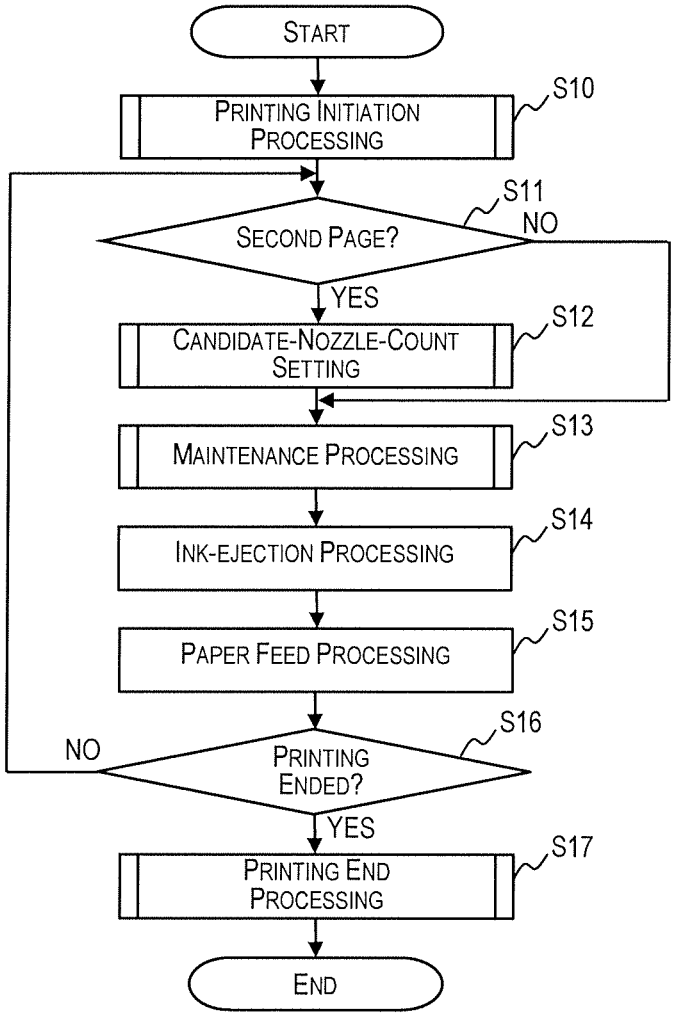
FIG. 9 is a flowchart showing the printing routines of the first embodiment.

Returning to the flowchart of FIG. 9, the controller 86 in step S17 performs printing end processing. In other words, the controller 86 controls the PF motor 52 so that the portion of the roll paper P on which the ink is deposited, i.e., the portion on which an image is formed, is ejected to the paper ejection part 24, and controls the CR motor 33 so that the print head 42 is moved to the home position. The controller 86 then causes the cap 61 to approach the print head 42 and caps the print head 42 for the purpose of protecting the print head 42, which is at the home position. The controller 86 then ends the printing routines.

Figure 11C:
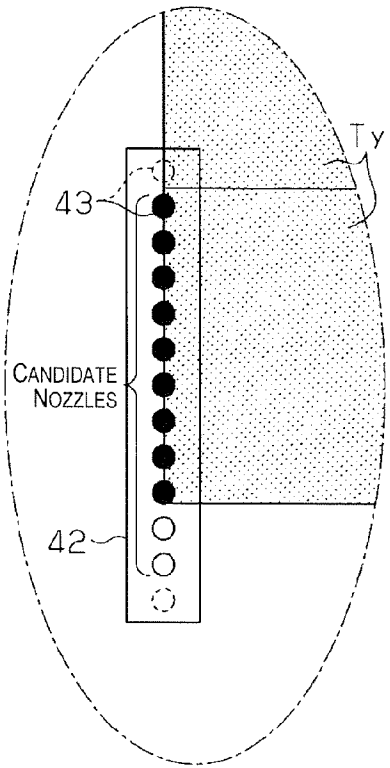
FIGS. 11B and 11C are enlarged views of portions of FIG. 11A.
Figure 11B:
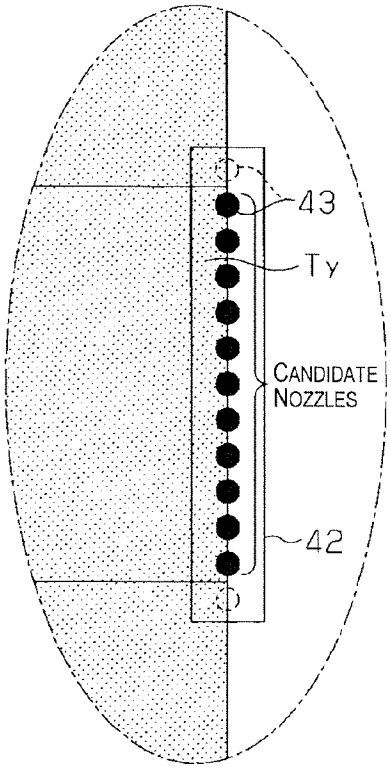

The following description will focus on the operation in the case of printing the second and subsequent pages in the printing performed by the printing device 11 of the present embodiment. In the second and subsequent pages of printing, the same image is printed on the roll paper P as the image that was formed on the roll paper P by the printing of the first page. For the sake of convenience in understanding the description given in this specification, the print head 42 in FIGS. 11A, 11B, and 11C has a single nozzle row 45, and the nozzle row 45 is composed of twelve nozzles 43. Of the twelve nozzles 43, ten are candidate nozzles, and the remaining two are unused nozzles. In FIGS. 11B and 11C, the unused nozzles are indicated by dashed-line circles, and the candidate nozzles are indicated by black-filled circles or solid-line circles.

Figure 11A:
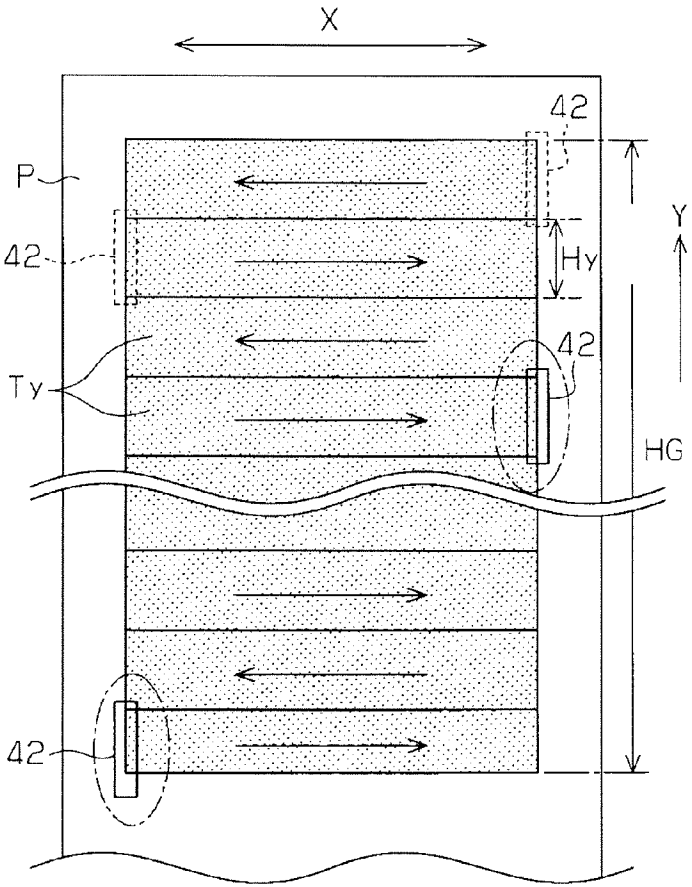
FIG. 11A is an operation view showing the manner in which printing is performed in the method of the first embodiment.

When printing of the second page is initiated, the carriage 32 begins to move in the forward direction (to the left in FIG. 11A), and ink is appropriately ejected toward the roll paper P from the candidate nozzles of the nozzles 43 that constitute the nozzle row 45, as shown in FIGS. 11A and 11B. When movement of the carriage 32 in the forward direction is completed, i.e., ink ejection based on a single scan of bitmap data is completed, the roll paper P is conveyed downstream in the secondary scanning direction Y by the paper feed processing. Then, when the paper feed processing is completed, the carriage 32 begins to move in the reverse direction (to the right in FIG. 11A), and ink is appropriately ejected toward the roll paper P from the candidate nozzles.

Since the printing pass count IP is set to an even number in the case of ink ejection based on the final divided printing data, the carriage 32 is positioned at the left side in FIG. 11A. As a result, the carriage 32 begins to move in the reverse direction, and ink is appropriately ejected toward the roll paper P from the candidate nozzles, as shown in FIGS. 11A and 11C. At this time, it is not necessarily the case that data based on the final divided printing data are allocated to all the candidate nozzles. Therefore, ink is not ejected from some (the nozzles indicated by solid-line circles in FIG. 11C) of the candidate nozzles. The reason for this is that the data length of the divided printing data last to be received does not match the data length Ds that is computed based on the relational expression (Equation 4) described above.

However, in the present embodiment, the printing pass count IP and the candidate nozzle count KN are set based on the length HG in the secondary scanning direction of the image that is printed in the first page. The difference (two in FIG. 11) between the candidate nozzle count KN and the number (also referred to as the "last usage count") of nozzles 43 used during ink ejection based on the final divided printing data therefore decreases relative to the difference in the known technique, in which all of the nozzles 43 are used for printing (see FIG. 8B).

The carriage 32 moving in the reverse direction then moves without further operation to the home position, and is capped by the cap 61. Printing of the third and subsequent pages is substantially the same as printing of the second page, and therefore will not be described.

Such effects as the following can be obtained through the embodiment described above.

(1) The printing width Hy in the secondary scanning direction Y of the single-scan region Ty of the roll paper P onto which the ink is deposited by a single movement of the carriage 32 is set to a length HG that corresponds to the size in the conveyance direction of the printing region that is specified based on the printing data. Driving of the print head 42 is controlled based on the printing width Hy that is set as described above. The range of variation of the printing width Hy of the single-scan region Ty can therefore be reduced in comparison with a case in which no consideration is made of the length HG in the conveyance direction of the printing region that is specified based on the printing data. As a result, it is possible to reduce the difference between the printing width Hy of the single-scan region Ty that is based on the final movement of the carriage 32, and the printing width Hy of the single-scan region Ty that is based on a movement of the carriage 32 previous to the final movement. Consequently, during printing on the roll paper P, it is possible to reduce driving of the printing means in which ink is not deposited onto the roll paper P.

Insofar as unnecessary driving of the printing means can be reduced, printing can be performed more efficiently.

(2) In the present embodiment, the length HG in the secondary scanning direction Y of the image formed on the roll paper P by the printing of the first page is acquired as the size in the conveyance direction of the printing region that is specified based on the printing data. Based on the length HG, the number of nozzles 43 constituting a single nozzle row 45 that are set as candidate nozzles, i.e., the candidate nozzle count KN, is computed. It is therefore possible to reduce the difference between the number of nozzles used during ink ejection based on the final divided printing data, i.e., the last usage count, and the number of nozzles used during ink ejection based on previous divided printing data, in comparison with the known technique in which ink ejection is performed without considering the length HG.

(3) In the present embodiment, ink is not discharged from the unused nozzles, which are the nozzles other than the candidate nozzles, in the flushing that is executed during printing. The ink consumption that accompanies flushing can therefore be reduced in comparison with a case in which flushing that involves ink discharge is performed from the unused nozzles as well.

(4) In the nozzle inspection processing executed at the start of printing, the unused nozzles, which are not used in the current printing, are not inspected. The time needed for nozzle inspection processing can therefore be reduced, and ink consumption during nozzle inspection processing can also be reduced in comparison with a case in which the unused nozzles are also inspected.

(5) Flushing processing is executed at the timing at which the time clocked by the first timer 113 reaches or exceeds the first reference value. Flushing processing is sometimes also performed immediately prior to the ink ejection that is based on the final divided printing data. At this time, among the candidate nozzles, ink is discharged also from the nozzles not used in the ink ejection that is based on the final divided printing data. In this respect, it is possible in the present embodiment to reduce the difference between the number of nozzles used during ink ejection based on the final divided printing data, i.e., the last usage count, and the number of nozzles used during ink ejection based on previous divided printing data, in comparison with the known technique in which ink ejection is performed without considering the length HG. In other words, insofar as it is possible to reduce the number of nozzles not used in ink ejection based on the final divided printing data, unnecessary ink consumption due to flushing can be reduced in comparison with the known technique. The number of drive elements driven during flushing processing can be reduced, and consequently, it is possible to reduce driving of the printing means in which ink is not deposited onto the roll paper P during printing on the roll paper P.

(6) In a case in which the printing scheme is the bidirectional printing scheme, the carriage 32 moves in the forward direction in the ink ejection based on the final divided printing data when the printing pass count IP is an odd number. In this case, the carriage 32 must be moved to the home position after the end of printing. This movement of the carriage 32 is a driving of the printing means that is not accompanied by ejection of ink to the roll paper P. In this respect, the printing pass count IP is set to an even number when the printing scheme is the bidirectional printing scheme in the present embodiment. The carriage 32 therefore moves in the reverse direction in the ink ejection based on the final divided printing data. When ink ejection to the roll paper P is ended, the carriage 32 moves without further operation to the home position and then enters a standby state. It is therefore possible to reduce driving of the printing means in which there is no depositing of ink onto the roll paper P during printing on the roll paper P.

(7) In the present embodiment, the candidate nozzle count KN is computed based on the length HG corresponding to the size in the conveyance direction of the printing region that is specified based on the printing data. The candidate nozzle count KN thus computed can often be less than the total number of nozzles 43 constituting a single nozzle row 45. In such cases, the data length Ds of the divided printing data received from the host device HC side is shorter than in a case in which all of the nozzles constituting a single nozzle row 45 are used for printing. As a result, the time needed for reception, expansion, and generation of data can be reduced. It is therefore possible to reduce the standby time of the carriage 32 that elapses before generation of a single scan of bitmap data is completed.

Ink can also be ejected to the roll paper P by the current ink ejection before the ink deposited onto the roll paper P by the previous ink ejection is dry. Therefore, even when overlapping occurs between a portion of the region in which ink is deposited by the current ink ejection and a portion of the region in which ink was deposited by the previous ink ejection, the risk of a decline in image quality can be reduced.

(8) A trend in recent years is for the resolution of images printed on roll paper P to increase, and this increase tends to result in a larger volume of printing data. The time needed for reception, expansion, and generation of data therefore increases, and the standby time of the carriage 32 during printing tends to increase. In this respect, insofar as the time needed for reception, expansion, generation, and other processing of data can be reduced in the present embodiment, the time needed for printing can be prevented from increasing even when the image resolution increases.

Second Embodiment

A second embodiment of the invention will next be described based on FIG. 12. The second embodiment differs from the first embodiment with respect to some of the parameters for setting the candidate nozzle count KN. Consequently, the following description will focus primarily on those aspects that differ from the first embodiment. Constituent elements that are the same as or correspond to the first embodiment are referred to by the sane reference symbols, and no redundant descriptions thereof will be given.

The present embodiment differs from the first embodiment in that the printing pass count IP and other values are computed based on information relating to the printing region or roll paper size that is set on the host device HC side.

Figure 12:
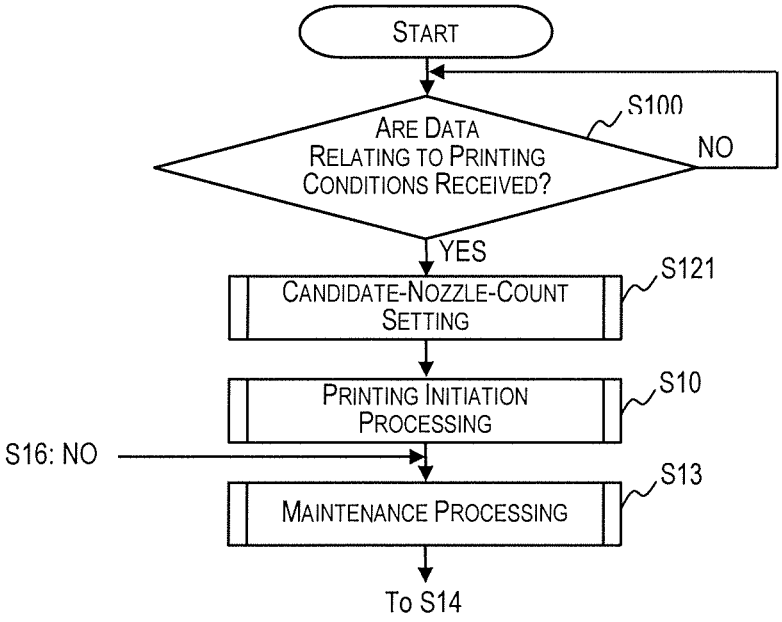
FIG. 12 is a flowchart showing a portion of the printing routines according to a second embodiment.

The printing routines executed by the controller 86 in the present embodiment will therefore next be described based on the flowchart shown in FIG. 12.

The printing routines are executed when printing data begins to be received from the host device HC. In the first step S100, the controller 86 determines whether reception of data relating to the printing conditions is completed. In a case in which reception of data relating to the printing conditions is in progress (step S100: NO), the determination processing of step S20 is repeated, and in a case in which reception of data relating to the printing conditions is completed (step S100: YES), the processing transitions to the next step S121.

In step S121, the controller 86 performs candidate nozzle count setting processing for setting the candidate nozzle count KN, the same as in step S12 described above. In the present embodiment, however, the controller 86 computes the candidate nozzle count KN by using the length in the secondary scanning direction Y of the printing region in the roll paper P that is included in the received printing conditions, or the length in the secondary scanning direction Y of a single page of paper, instead of the length HG in the secondary scanning direction Y of the image printed on the roll paper P.

The controller 86 then performs printing initiation processing (step S10), and then performs maintenance processing (step S13). Subsequent processing is the same as in the first embodiment, and therefore will not be described.

The effects described below can be further obtained by the present embodiment, in addition to the same effects as effects (1) through (8) of the first embodiment.

(9) In the present embodiment, the candidate nozzle count KN and the data length Ds are computed based on the printing region or paper size included in data relating to printing conditions that are first to be received when printing is initiated. An image can therefore be printed on the roll paper P in a state in which the candidate nozzles or the printing pass count IP is set from the time of the printing of the first page.

Third Embodiment

Figure 13:
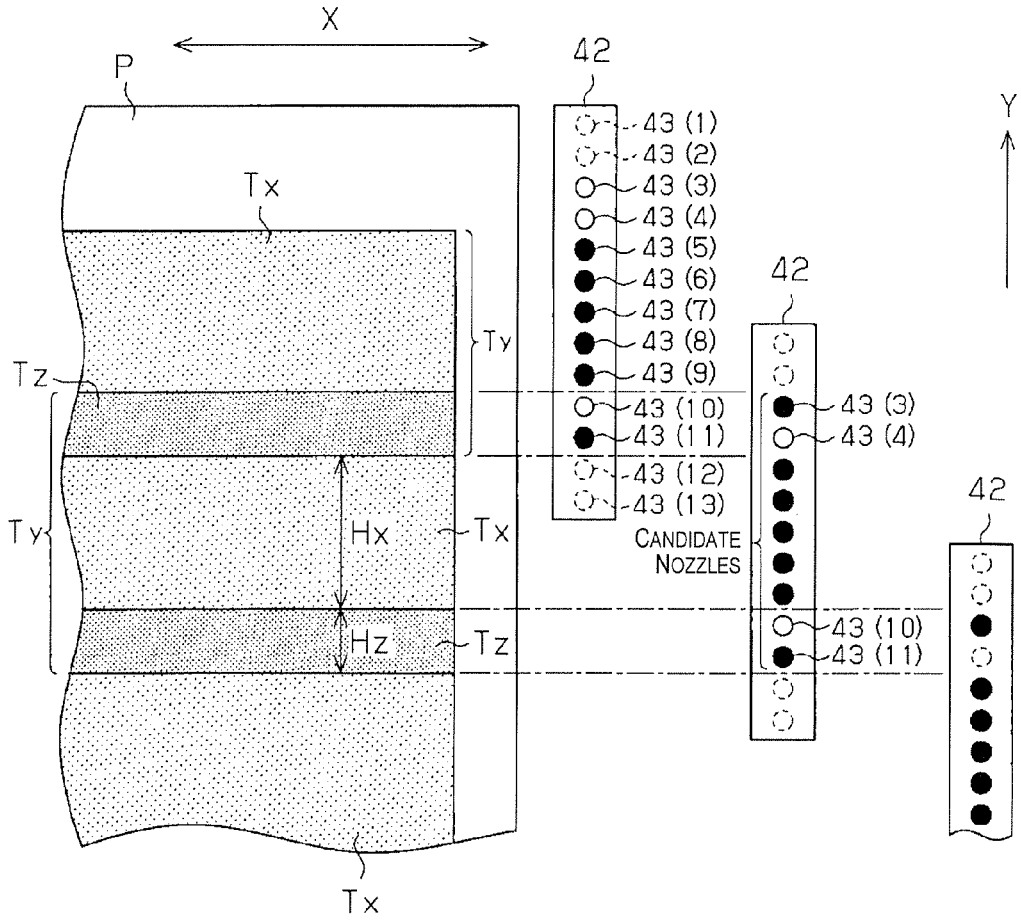
FIG. 13 is an operation view showing the manner in which printing is performed in a third embodiment.

A third embodiment of the invention will next be described based on FIG. 13. The third embodiment differs from the first and second embodiments with respect to a portion of the printing method. Consequently, the following description will focus primarily on those aspects that differ from the first and second embodiments. Constituent elements that are the same as or correspond to the first and second embodiments are referred to by the same reference symbols, and no redundant descriptions thereof will be given.

In the present embodiment, printing is performed according to a microweave printing scheme. This microweave printing scheme is a scheme for overlapping a portion (the downstream-end part (upper end part in FIG. 13) in the secondary scanning direction Y) of the single-scan region Ty formed by the current ink ejection with a portion (the upstream-end part (lower end part in FIG. 13) in the secondary scanning direction Y) of the single-scan region Ty formed by the previous ink ejection, as shown in FIG. 13. The portion of the single-scan region Ty in which the single-scan regions Ty of the previous and next ink ejections overlap is referred to as a "first region Tz," and the portion of the single-scan region Ty other than the first region Tz is referred to as a "second region Tx." In the present embodiment, the ratio α of the width Hx in the secondary scanning direction Y of the second region Tx with respect to the width Hz in the secondary scanning direction Y of the first region Tz is a constant value (e.g., 4) even when the candidate nozzle count KN fluctuates.

A description will be given of the method whereby the nozzle count setting part 111 sets the printing pass count IP in the case of the microweave printing scheme.

In a case in which printing is performed by the microweave printing scheme, a portion of the nozzles 43 aligned in the secondary scanning direction Y are non-overlapping nozzles that eject ink to the second region Tx in the single-scan region Ty. The remaining nozzles are overlapping nozzles that eject ink to the first region Tz. In a case in which the number of non-overlapping nozzles is "Nx," and the number of overlapping nozzles is "Nz," since the nozzles 43 constituting the nozzle row 45 are arranged at equal intervals, the relationship between the non-overlapping nozzle count Nx and the overlapping nozzle count Nz is indicated by the relational expression (Equation 5) shown below.

$$\alpha = \frac{Nx}{Nz} \quad \text{[Eq. 5]}$$

α: Ratio; Nx: Non-overlapping nozzle count; Nz: Overlapping nozzle count

In the printing of the first page, all of the nozzles 43 constituting a single nozzle row 45 are used. Therefore, in the printing of the first page, when the ratio α is "4" and the nozzle row 45 is composed of "360" nozzles 43, the non-overlapping nozzle count Nx is "240," and the overlapping nozzle count Nz is "60." The number of movements of the carriage 32 that are accompanied by ink ejection, i.e., the printing pass count IP, for the second and subsequent pages is computed based on the relational expression (Equation 6) shown below. In cases in which there is a number after the decimal point in the computed value, the value obtained by rounding up after the decimal point is used as the printing pass count IP. In this instance, when the printing pass count IP computed based on the relational expression (Equation 6) is an odd number in a case in which the printing scheme is the bidirectional printing scheme, the printing pass count IP is incremented by "1" to obtain an even number. The non-overlapping nozzle count Nx and overlapping nozzle count Nz substituted into the relational expression (Equation 6) are the values for the printing of the first page (Nx=240 and Nz=60 in this case). In a case in which the length HG of the image in the secondary scanning direction Y is "55," and the nozzle pitch r (see FIG. 4) is "0.07," the printing pass count IP becomes "3."

When the printing pass count IP for second and subsequent pages of printing is computed, the non-overlapping nozzle count Nx and the overlapping nozzle count Nz are computed based on the relational expression (Equation 7) shown below and the relational expression (Equation 5) described above, respectively. In a case in which the ratio α is "4," the non-overlapping nozzle count Nx becomes "168," and the overlapping nozzle count Nz becomes "42." In other words, the candidate nozzle count KN (=Nx+2×Nz) becomes "252."

$$IP=(HG+Nz\times r)\div[(Nz+Nx)\times r] \quad \text{[Eq. 6]}$$

IP: Printing pass count IP; HG: Length of the image in the secondary scanning direction Y; r: Nozzle pitch; Nz: Overlapping nozzle count; Nx: Non-overlapping nozzle count A description will be given of the processing of the image expansion processing part 112 in the case of printing the second and subsequent pages in the printing performed by the printing device 11 of the present embodiment. The same image formed on the roll paper P by the printing of the first page is assumed to be printed on the roll paper P in printing of the second and subsequent pages. In FIG. 13, the number of nozzles 43 constituting a single nozzle row 45 is assumed to be thirteen, and among the nozzles 43(1) through 43(13), nozzles 43(3) through 43(11) are set as candidate nozzles, and nozzles 43(1), 43(2), 43(12), and 43(13) are set as unused nozzles which are not candidate nozzles.

A first case in which divided printing data corresponding to the microweave printing scheme are received by the controller 86, and a second case in which divided printing data not corresponding to the microweave printing scheme are received by the controller 86 will be considered in a case of printing by the microweave printing scheme. In the first case, the image expansion processing part 112 of the controller 86 converts the received divided printing data into bitmap data and expands the bitmap data. The image expansion processing part 112 generates a single scan of bitmap data so that data corresponding to the expanded bitmap data are allocated to the candidate nozzles 43(3) through 43(11), and dummy data are allocated to the unused nozzles 43(1), 43(2), 43(12), and 43(13).

In the second case, the image expansion processing part 112 of the controller 86 converts the received divided printing data into bitmap data and expands the bitmap data. The image expansion processing part 112 then generates a single scan of bitmap data so that data are allocated to nozzles 43(1) through 43(13) by the method described below.

Specifically, the image expansion processing part 112 allocates data corresponding to the expanded bitmap data to the candidate nozzles 43(5) through 43(9) that correspond to the second region Tx, among the candidate nozzles 43(3) through 43(11). The image expansion processing part 112 also allocates expanded bitmap data to candidate nozzles at a predetermined interval in the secondary scanning direction Y, among the candidate nozzles 43(3), 43(4), 43(10), and 43(11) that correspond to the first region Tz. In FIG. 13, the image expansion processing part 112 allocates data corresponding to expanded bitmap data to the candidate nozzles 43(3) and 43(11), and allocates dummy data to the candidate nozzles 43(4) and 43(10), among the candidate nozzles 43(3), 43(4), 43(10), and 43(11). The image expansion processing part 112 also allocates dummy data to the unused nozzles 43(1), 43(2), 43(12), and 43(13).

Consequently, the effects described below can be further obtained by the present embodiment, in addition to the same operations/effects as those of the first and second embodiments.

(10) In the printing performed in the present embodiment, overlapping occurs between a portion of the single-scan region Ty formed by the current ink ejection and a portion of the single-scan region Ty formed by the previous ink ejection. It is therefore preferred from the standpoint of enhancing image quality to perform the current ink ejection before the ink deposited onto the roll paper P by the previous ink ejection is dry. In this respect, since the data length Ds is set based on the length HG in the secondary scanning direction Y of the image printed on the first page in the present embodiment, it is possible to reduce the standby time of the carriage 32 during printing. As a result, it is possible to reduce the time difference between the end of the previous ink ejection and the start of the current ink ejection. Consequently, it is possible to increase the ability to perform the current ink ejection before the ink deposited onto the roll paper P by the previous ink ejection is dry, thereby contributing to enhanced quality of the image printed on the roll paper P.

The embodiments described above can be modified as described below.

In the embodiments described above, the printing pass count IP or the candidate nozzle count KN can be set based on the data length of the acquired printing data instead of on the length HG in the secondary scanning direction Y of the image printed on the first page, the set paper size, and the set printing region. In this case, however, the printing device 11 can perform printing after reception of the printing data is completed.

In the third embodiment, the ratio $\alpha$ can be an arbitrary number other than "4" (e.g., 5 or 0.5).

In the third embodiment, in the case of the microweave printing scheme, the non-overlapping nozzle count Nx and the overlapping nozzle count Nz can be set by the method described below. Specifically, the non-overlapping nozzle count Nx can be constant, and the overlapping nozzle count Nz can be the value obtained by subtracting the non-overlapping nozzle count Nx from the candidate nozzle count KN. However, in a case in which the relational expression (Equation 8) shown below is established, the overlapping nozzle count Nz can be "0 (zero)," and the non-overlapping nozzle count Nx can be computed based on the relational expression (Equation 9) shown below.

$$IP \times Nx + (IP-1) \times Nz = HG + r \quad \text{[Eq. 7]}$$

Nx: Non-overlapping nozzle count Nx; IP: Printing pass count; r: nozzle pitch; HG: length of the image in the secondary scanning direction Y The length in the secondary scanning direction Y of the printing region that is set on the host device HC side, or the length of the paper in the secondary scanning direction Y can be substituted for the length HG.

In the second embodiment, a configuration can be adopted in which the host device HC side sets the candidate nozzle count or which nozzles to make candidate nozzles and notifies the controller 86, and the controller 86 sets the candidate nozzle count or which nozzles to make candidate nozzles on the basis of the notification from the host device HC.

In the embodiments, when the candidate nozzle count KN is computed, nozzles that are positioned downstream in the secondary scanning direction Y can be set as candidate nozzles among the nozzles 43 constituting a single nozzle row 45. Nozzles that are positioned upstream in the secondary scanning direction Y can also be set as candidate nozzles among the nozzles 43 constituting a single nozzle row 45. Nozzles positioned at the center in the secondary scanning direction Y can also be set as candidate nozzles among the nozzles 43 constituting a single nozzle row 45.

In the embodiments, the ones digit of the candidate nozzle count KN that is computed based on the relational expression (Equation 3) described above can be rounded up. In this case, the candidate nozzle count KN is set in units of "10" on the basis of the size in the secondary scanning direction Y of the printing region that is set based on the printing data.

In the embodiments, a configuration can be adopted in which ink is not discharged from the unused nozzles, which are the nozzles 43 other than the candidate nozzles, when flushing is performed during printing, but ink is discharged from all of the nozzles 43 in flushing that is executed at a time other than during printing. A configuration can also be adopted in which ink is discharged at each cycle from the candidate nozzles when flushing is performed during printing, but ink is discharged once in a plurality of cycles from the unused nozzles, which are the nozzles other than the candidate nozzles.

Such a configuration makes it possible to suppress blockage of nozzles 43 due to such effects as increased viscosity of ink in the nozzles 43.

A configuration can also be adopted in which all the nozzles 43 are inspected in nozzle inspection that is executed at a time other than during printing.

In the embodiments, a configuration can be adopted in which the maintenance device 60 is not provided with the nozzle inspection device 64.

In the embodiments, the printing device can be implemented as a printing device in which the print head 42 moves in relative fashion in a predetermined conveyance direction with respect to the printing medium during printing.

In the embodiments, the printing device 11 can be a printing device capable of directly acquiring printing data from an external memory (a memory card or the like), an electronic camera, or other component without the intervention of the host device HC. In this case, printing data stored in the external memory are copied to a memory (the RAM 85 or other memory) in the printing device 11, and printing is performed based on the printing data stored in the memory.

The printing device 11 can also be a multifunction device provided with a scanner part or the like.

In the embodiments, the printing device 11 can be a so-called line-head-type printing device in which the print head does not move during printing, or the printing device 11 can be a so-called lateral-type printing device in which a plurality of print heads 42 is disposed in the primary scanning direction X. The nozzles 43 are preferably disposed in the conveyance direction of the printing medium in this printing device as well.

Insofar as the printing medium and the print head move relative to each other, a configuration can be adopted in which the printing medium is not conveyed, and the print heat moves, for example. In a serial-type inkjet printer, for example, the print head 42 can be moved relative to the roll paper P in the primary scanning direction X. The roll paper P can also be moved relative to the print head 42 in the secondary scanning direction Y.

In the embodiments, the printing medium printed by the printing device 11 is not limited to roll paper, and can be other paper (e.g., single-sheet paper).

In the embodiments, the printing device 11 can be implemented as a so-called on-carriage-type printer in which ink cartridges 14 are detachably mounted on the carriage 32.

An inkjet printer is employed as the printing device 11 in the embodiments, but a liquid ejection device can also be employed which ejects or discharges a liquid other than ink. The invention can also be applied to various types of liquid ejection devices which are provided with a liquid ejection head or the like for discharging minute droplets. The term "droplet" refers to the state of the liquid discharged from the liquid ejection device, and includes droplets which leave granular, teardrop-shaped, or filament-shaped traces. The liquid referred to herein can be any material which can be ejected by the liquid ejection device. For example, the liquid is preferably in a state in which the material thereof is in the liquid phase, and includes not only fluids and materials that are liquid in one state thereof, such as high or low-viscosity liquids, sol/gel solutions, and other inorganic solvents, organic solvents, solutions, liquid resins, and liquid metals (metal liquids), but liquids in which particles of functional material composed of pigments, metal particles, and other solids are dissolved, dispersed, or mixed in a solvent. Ink, liquid crystal, or the like such as described in the embodiments above are cited as typical examples of the liquid. The term "ink" includes common water-based ink, oil-based ink, gel ink, hot-melt ink, and various other liquid compositions. Specific examples of the liquid ejection device can include liquid ejection devices for ejecting liquid which includes electrode material, color material, or other material in dispersed or dissolved form for use in such applications as manufacturing liquid crystal displays, EL (electroluminescent) displays, surface-emitting displays, and color filters; liquid ejection devices for ejecting biological organic materials used to manufacture biochips; liquid ejection devices used as precision pipettes for ejecting liquids as test samples; and textile printing devices, microdispensers, and the like. Liquid ejection devices for ejecting lubricating oil with pinpoint precision onto a clock, camera, or other precision machine; liquid ejection devices for ejecting UV-curing resin or other transparent resin liquids onto a substrate to form micro hemispherical lenses (optical lenses) used in an optical communication device or the like; and liquid ejection devices for ejecting acid or alkaline etching solution for etching a substrate or the like can be used. The invention can be applied to any of these types of liquid ejection devices. The liquid can also be toner or another granular material. The liquid referred to in the present specification does not include materials composed solely of a gas.

In the embodiments, the printing device 11 can be a printing device which operates according to a dot impact scheme, a laser scheme, or another printing scheme.

In the second embodiment, the printing width of the single-scan region Ty in the secondary scanning direction Y can be acquired by the printer driver PD. Specifically, the printer driver PD uses the relational expressions (Equation 2) through (Equation 4) to compute the printing pass count IP, the candidate nozzle count KN, and the data length Ds on the basis of the paper size and other parameters set by a user on the printing device 11 side. The printer driver PD can also transmit divided printing data having the computed data length Ds in sequence to the printing device 11.

A configuration can be adopted in which the processing performed by the printing device 11 in the embodiments is performed by the printer driver PD, and the processing performed by the printer driver PD in the embodiments is performed by the printing device 11.

The embodiments and modifications described above can be combined.

A technical idea that can be grasped from the abovementioned embodiments and other embodiments is added as a postscript below.

(A) A program executed by a host device for transmitting printing data to a printing device, wherein the program executes, in a control part of the host device, the steps of setting the data length of data transmitted to the printing device by a single communication, on the basis of the size of a printing region that is specified based on the printing data; and sequentially transmitting, to the printing device, divided printing data which are generated by dividing the printing data into units of the data length set in the previous step.

The entire disclosure of Japanese Patent Application No. 2010-159583, filed Jul. 14, 2010, is incorporated by reference herein.

What is claimed is:

1. A printing device comprising:

a printing unit that has a print head configured to deposit a printing material on a printing medium to print an object on the basis of printing data;

a conveyance unit that moves the printing medium in a conveyance direction in relation to the print head; and a printing control unit that confirms a size of the object in the conveyance direction from the printing data, and that controls the printing unit and the conveyance unit on the basis of the printing data to print the object, the printing device including a printing width setting unit that sets, on the basis of the size, a printing width in the conveyance direction in a single driving in which the print head reciprocates for printing one time in a scanning direction being perpendicular to the conveyance direction, the printing control unit that controls the printing unit and the conveyance unit on the basis of the printing width.

2. The printing device according to claim 1, wherein the printing width setting unit sets the printing width so that a variation in the printing width decreases through printing performed based on the printing data.

3. The printing device according to claim 1, wherein the print head has a plurality of nozzles for ejecting the printing material, and each of the nozzles is arranged in the conveyance direction;

the printing width setting unit sets the nozzles to any of a first nozzle and a second nozzle on the basis of the size of the printing region in the conveyance direction; and the printing control unit controls the print head so that the printing material is ejected to the printing medium from the first nozzle, and the printing material is not ejected to the printing medium from the second nozzle during printing based on acquired printing data.

4. The printing device according to claim 1, wherein the printing unit further includes a moving body that moves in a reciprocating fashion in relation to the printing medium in a scanning direction that intersects the conveyance direction, the moving body supporting the print head;

the printing control unit is configured so as to control the printing unit so that the printing material is deposited onto the printing medium while the moving body is moved in relative fashion from one side to the other side in the scanning direction, and subsequently, to control the printing unit so that the printing material is deposited onto the printing medium while the moving body is moved in relative fashion from the other side to the one side in the scanning direction; and the printing width setting unit sets the printing width so that the number of movements of the moving body is an even number during printing based on the printing data, on the basis of the size of the printing region in the conveyance direction.

5. The printing device according to claim 3, further comprising:

a printing material receiving part for receiving the printing material ejected from the print head; and maintenance control unit for controlling the printing unit so that the printing material is ejected from the print head into the printing material receiving part, in order to maintain precision of printing on the printing medium; wherein the maintenance control unit places the printing material receiving part opposite the print head partway during printing on the printing medium, and causes the printing material to be ejected to the printing material receiving part from the first nozzle, while restricting ejection of the printing material to the printing material receiving part from the second nozzle.

6. The printing device according to claim 1, further comprising:

information acquisition unit for acquiring, as the size of the printing region in the conveyance direction, at least one of a length in the conveyance direction of the printing medium on which printing is performed, a length in the conveyance direction of an image printed on the printing medium on the basis of the printing data, and a data length of the printing data; wherein the printing width setting unit sets the printing width in the conveyance direction of a region of the printing medium onto which the printing material is deposited by a single driving of the printing unit, on the basis of the results of acquisition by the information acquisition unit.

7. A printing device comprising:

an acquisition unit that acquires printing data;

a print head including a plurality of nozzles for ejecting a printing material;

a movement mechanism for moving the print head in relation to a printing medium;

a classification unit that classifies the nozzles as any of a first nozzle and a second nozzle on the basis of the size of a printing region that is specified based on the printing data acquired by the acquisition unit; and a printing control unit that controls the driving of the print head and the movement mechanism so that the printing material is ejected to the printing medium from the first nozzle selected by the classification unit and the printing material is not ejected to the printing medium from the second nozzles during printing on the printing medium on the basis of the printing data acquired by the acquisition unit.

8. A control method for driving a printing unit and conveyance unit, the having a print head to print an object on the basis of printing data on a printing medium by depositing a printing material thereon, the printing medium being conveyed in a conveyance direction by a conveyance unit; the printing method comprising:

confirming a size of the object in the conveyance direction from the printing data;

setting, on the basis of the size, a printing width in the conveyance direction in a single driving of the printing unit in which the print head reciprocates for printing one time in a scanning direction being perpendicular to the conveyance direction; and controlling the printing unit and the conveyance unit causing the printing material to be deposited onto the printing medium by the printing unit and the printing medium to move in relative fashion in a predetermined conveyance direction, on the basis of the nozzle to be used or the printing width set in the setting.

* * * * *